US008950158B2

(12) United States Patent
Walton

(10) Patent No.: US 8,950,158 B2
(45) Date of Patent: Feb. 10, 2015

(54) CELLULAR ANTENNA TOWER AND EQUIPMENT ENCLOSURE BASED ON SHIPPING CONTAINER

(71) Applicant: Chadwick J. Walton, Bangor, ME (US)

(72) Inventor: Chadwick J. Walton, Bangor, ME (US)

( * ) Notice: Subject to any disclaimer, the term of this patent is extended or adjusted under 35 U.S.C. 154(b) by 0 days.

(21) Appl. No.: 13/844,745

(22) Filed: Mar. 15, 2013

(65) Prior Publication Data

US 2014/0259978 A1 Sep. 18, 2014

(51) Int. Cl.

| | |
|---|---|
| ***E04B 1/00*** | (2006.01) |
| ***H01Q 1/12*** | (2006.01) |
| ***E04H 1/00*** | (2006.01) |
| ***E04H 12/34*** | (2006.01) |

(52) U.S. Cl.

CPC ..... *H01Q 1/12* (2013.01); *E04H 1/005* (2013.01); *E04H 12/342* (2013.01)

USPC ..... 52/745.18; 52/741.14; 52/110; 52/79.1

(58) Field of Classification Search

USPC ..... 52/110, 79.1, 169.6, 169.7, 741.12, 52/741.14, 745.18

See application file for complete search history.

(56) References Cited

U.S. PATENT DOCUMENTS 5,706,614 A * 1/1998 Wiley et al. ..... 52/79.1

* cited by examiner

*Primary Examiner* — William Gilbert
*Assistant Examiner* — Gisele Ford
(74) *Attorney, Agent, or Firm* — W. F. Fasse

(57) ABSTRACT

An antenna tower structure for wireless communication antennas includes an antenna cupola mounted on a tower based on at least one standardized ISBU shipping container that has been modified and erected to stand upright on a foundation. The modifications may include longitudinal reinforcements along at least two longitudinal edges of the container, mounting hardware at the two ends of the container, an access door on a side of the container, an access hatch in the upper end of the container, a ladder extending longitudinally inside the container, and a floor extending perpendicular to the longitudinal axis of the container. The container provides a weather-protected climate-controlled interior space for sheltering electronics equipment. The cupola has antennas installed on at least one level, and may include shutters, a clock, a bell etc. to hide the antennas and disguise the tower. The exterior of the structure may be finished to match surrounding buildings.

20 Claims, 21 Drawing Sheets

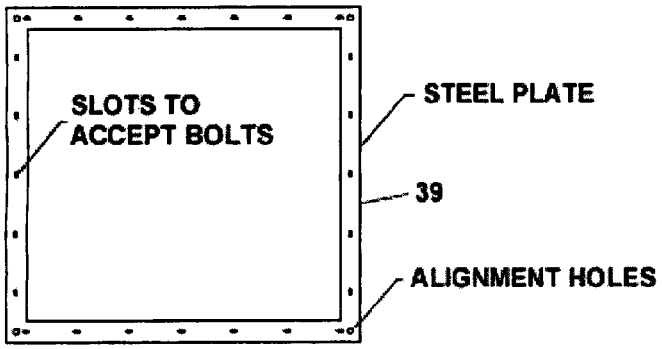
TOP CONNECTOR PLATE
FIG. 22A
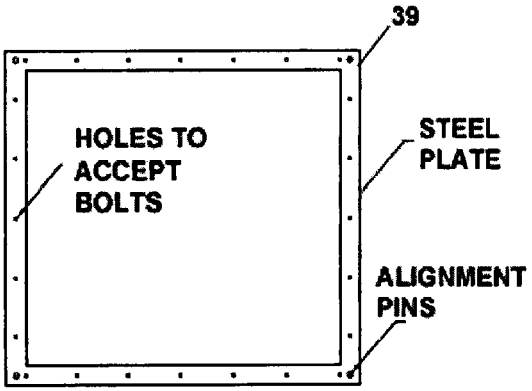
BOTTOM CONNECTOR PLATE
FIG. 22B
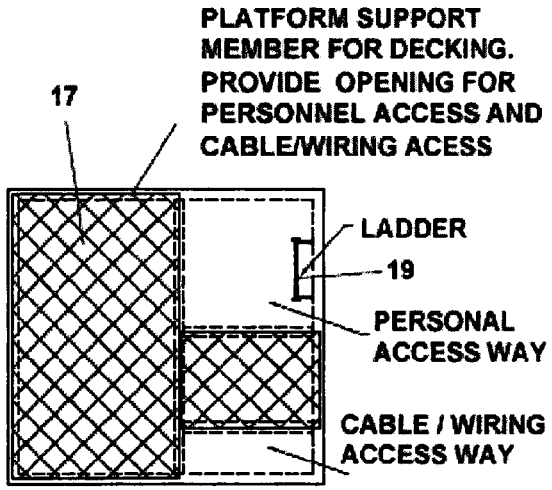
PLATFORM SUPPORT DECK FIG. 22C
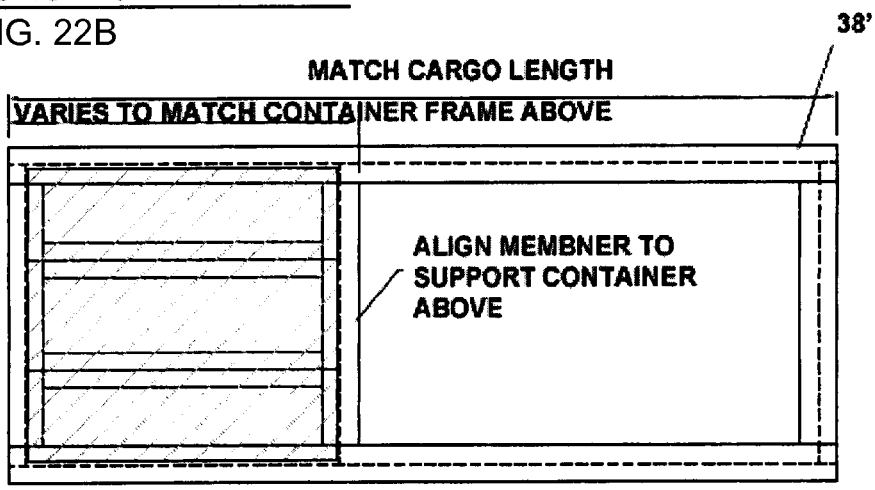
SKID PLATE PLAN VIEW FIG. 22D
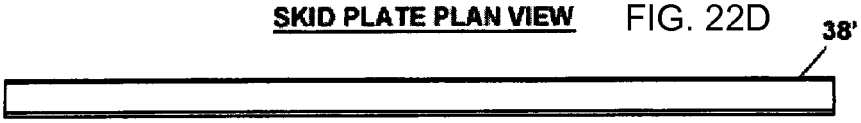
SKID PLATFORM ELEVATION FIG. 22E

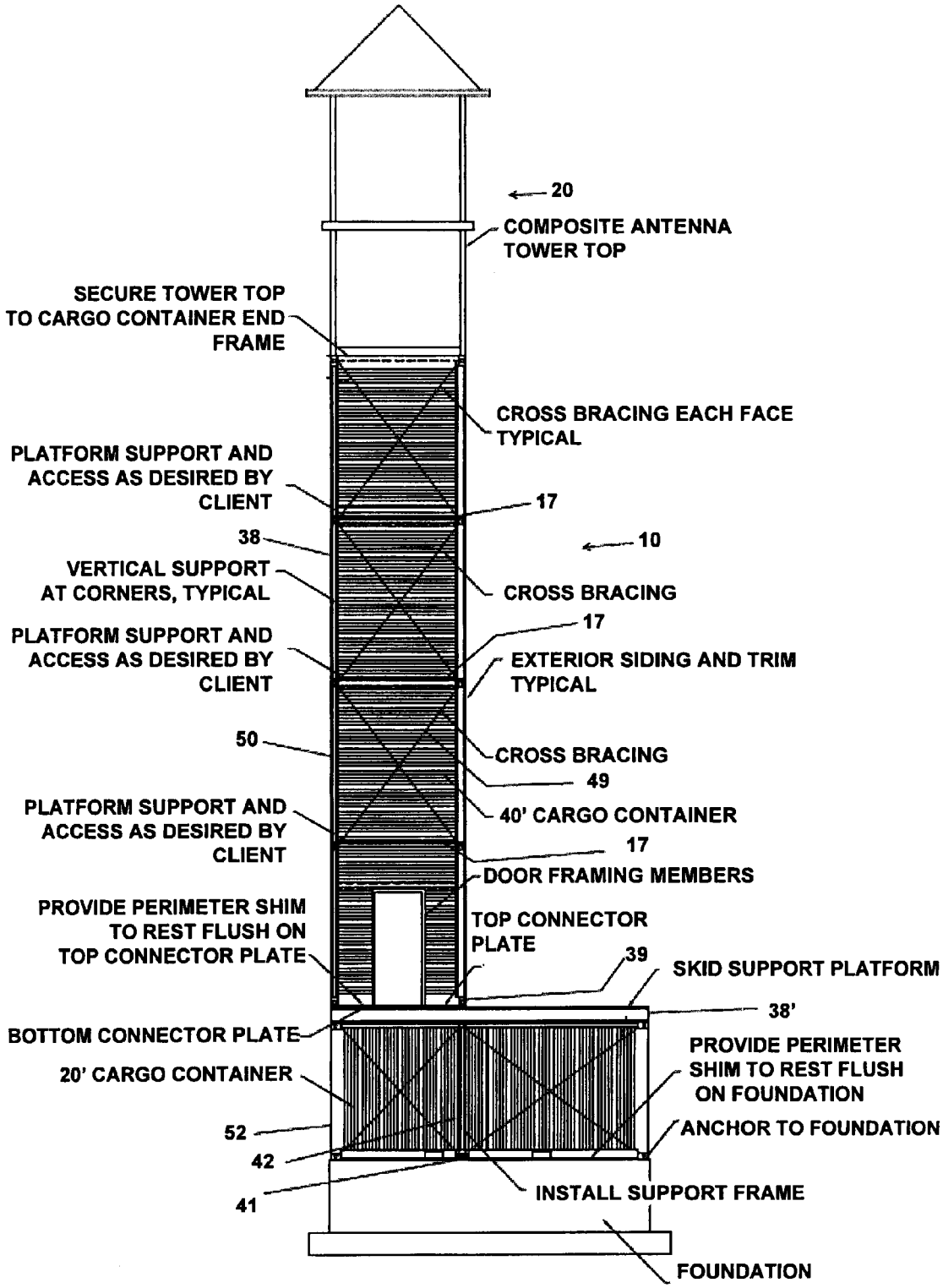
FIG. 22F ELEVATION PLAN

PLATFORM SUPPORT DECK

VERTICAL 20'

ELEVATION PLAN VERTICAL LAYOUT 2

VERTICLE 40'

ELEVATION PLAN VERTICLE LAYOUT 4

VERTICAL 20' AND 40'
ELEVATION PLAN VERTICAL LAYOUT 3

CELLULAR ANTENNA TOWER AND EQUIPMENT ENCLOSURE BASED ON SHIPPING CONTAINER

FIELD OF THE INVENTION

The invention relates to a structure that serves as a tower for mounting wireless communication antennas and sheltering associated wireless communication base station equipment, as well as a method of deploying such a structure.

BACKGROUND INFORMATION

So-called "cell towers" have become ubiquitous in urban, suburban and rural areas in the United States and around the world. While there is a high and growing demand for cellular telephone and other wireless communication services, many people object to the appearance of conventional cell towers and do not want such towers installed in their neighborhoods or areas where the view is important. Thus, wireless service providers are faced with a dilemma: they must install additional cell sites if they wish to improve and expand their wireless coverage and their range of wireless services to satisfy customer demand; but they are often faced with strong public objection, unwillingness of building and land owners to lease the required space, and local zoning restrictions against erecting additional cell towers in the areas where they are needed to satisfy the local demand for wireless service.

Such "cell towers" are also known as "cell sites", because some cell sites do not involve a tower at all, but rather merely comprise antennas mounted on an existing building or other structure and the associated electronic equipment housed in the structure or in a separate shelter, cabinet or enclosure. If no suitably located, and sufficiently tall, existing structure is available, then a tower must be erected to carry the necessary antennas, and a shelter, cabinet or enclosure must be provided to house the required equipment, shelter it from the elements and protect it from tampering. Typical types of towers include a lattice tower having zig-zag truss members tying together vertical corner members, a monopole tower in the form of a single cylindrical hollow pole, a guyed tower that may have a lattice construction or a monopole construction plus several guy wires extending away from the tower and anchored into the ground so as to stabilize and reinforce the tower, and various "stealth" or concealed towers that may have specialized construction and exterior camouflage finishing so as to try to hide or blend the tower into the existing surrounding urban or rural landscape. The equipment enclosure is typically in the form of a pre-fabricated steel cabinet, shelter, shed or building in which the necessary equipment is housed. Such an equipment enclosure is typically erected or placed on a concrete pad or other foundation adjacent to the foot of the tower.

The base transmitter station and other electronic equipment required for such a cell site may include electronic transmitters and receivers or transceivers, amplifiers, digital signal processors, control electronics, a GPS receiver and processor, primary and backup electrical power sources, and computer hardware and software for call handling and handoff, channel allocation, bandwidth management, etc. as well as a backhaul communication cable connection to a remotely located mobile telephone switching office or mobile switching center for overseeing and controlling the call handling, channel allocation, frequency reassignment, etc. among several cell sites. The backhaul connection may be via a high capacity cable, e.g. in urban and suburban areas, or via a microwave link through one or more microwave antennas also mounted on the tower. The electrical power equipment typically includes a backup battery bank, a transformer and a connection to the power grid or an off-grid power supply such as a generator, solar panel array, wind turbine or fuel cell power source. If the equipment shelter is completely weather-tight and climate controlled (requiring additional heating, ventilating and air-condition equipment), then the electronics equipment to be housed in the shelter can be of the indoor type. On the other hand, often it is necessary to use outdoor certified equipment packages that provide all the necessary equipment, sheltering and climate control in a self-contained ready-to-deploy unit. However, such outdoor certified equipment packages come at a much higher cost, approximately double, compared to the cost of indoor type equipment.

The cell tower may also host other wireless communication and broadcast facilities including antennas and associated electronics equipment for radio broadcast, television broadcast, RF communication e.g. for walkie-talkie, mobile radio, and government frequency communication, as well as microwave communication and repeater links. Throughout the present disclosure, the term wireless communication is used broadly and encompasses all forms of wireless transmission and/or reception of any type of communication signal including voice, audio, video, data, location and locating signals, etc. The types of antennas carried by such cell towers may include omnidirectional antennas, sectoral antennas, surface wave antennas, micro strip antennas, array antennas, parabolic reflector antennas, dish antennas, and all other types of antennas for wireless communication.

The conventional cell sites suffer various problems, for example as follows. The ever increasing number of cellular telephones and other mobile wireless devices communicating via cellular networks is overburdening the available capacity of the existing cell cites. Namely, each cell site has a limited number of channels available and can thus handle only a limited number of simultaneous calls or communications, and each channel has a limited bandwidth i.e. a limited rate of data transfer. More cell phone and mobile wireless device users in a given area thus require more available channels, and the modern wireless devices transmitting audio, video, internet information and other data have a much higher demand for bandwidth than simple voice calls on cellular telephones. As a result, cellular service providers must erect a rapidly growing number of additional cell sites with smaller cellular coverage areas for each site, to provide a higher area density of available cell channels and bandwidth. For example, so-called "offload sites" on smaller towers are being erected to provide buffering and handle excess call volume shifted from larger primary sites on higher towers. These offload sites must have their antennas within a line of sight to a larger primary tower or between two larger primary towers for which they are providing offload or buffering service. Thus, it is becoming necessary to locate cell sites more closely together in urban and suburban areas to provide the required number of channels and the required bandwidth for each cell site's coverage area. As a result, cellular service providers need locations in existing urban and suburban landscapes where a new cell site may be installed. This becomes problematic for several reasons.

Most conventional cell towers are generally regarded as visually unattractive because they clutter or interrupt the existing skyline with unfamiliar or harsh-looking mechanical structures. Many people thus object to having a cell tower erected within their viewing area around their home or business, although these people may also demand improved cellular service coverage. Also, some building codes, zoning ordinances and other local ordinances prohibit the erection of such a tower or any structure that does not blend-in or conform to existing or specified architectural styles and appearances. In order to provide the demanded cellular coverage in such areas, cellular service providers have sometimes camouflaged or concealed cell towers, so called stealth towers, for example to look like one of the existing surrounding palm trees, pine trees, utility poles, or existing architectural structures such as a church steeple or other tower. However, such camouflage or concealment efforts give rise to significant additional costs in the design and installation of the cell tower, as well as additional legal costs in obtaining the necessary local zoning and building permit approval. The process of obtaining community acceptance as well as local zoning or building permit approval also adds significant time delay to the planning and installation of a new cell site. Another approach at concealing a new cell site has been to mount the cellular antennas on an existing building or other structure and install the associated equipment in a room in the existing building or in a separate enclosure on the roof thereof. However, such installations on an existing building often require re-engineering and structural modifications of the existing building to support the added load of the cellular communication facilities and to achieve a stealthy concealment thereof without blocking the wireless transmission and reception of the antennas. Also, the antennas and equipment must remain accessible for maintenance, replacement and repair, usually on a continuous 24/7 basis. Therefore, the cellular service provider must have access to the existing building or at least the areas thereof housing the equipment and allowing access to the rooftop or other location of the antennas. That causes potential problems for the building owner, and also gives rise to liability issues if the installed facilities or any maintenance access cause damage (e.g. a leaking roof) to the existing building.

Even in rural areas where free-standing cell towers are more common than cell sites installed in existing buildings, typical cell towers are still considered unattractive. Because cell towers are generally located relatively close to populated or well-traveled areas (e.g. along a highway) even in rural areas, a typical cell tower may be objectionable because it mars the otherwise pristine natural beauty of the surrounding rural landscape. On the other hand, a tower in the style of a fire watch tower, an observation tower, a silo, a clock tower or a steeple may not be objectionable in such locations, because such towers are more familiar within the rural landscape.

In addition to an unattractive appearance, conventional cell towers suffer a significant problem of icing during the winter in northern climes. Namely, atmospheric moisture in the form of rain, snow, fog, mist or even just high humidity tends to condense and then freeze on the metal truss members of lattice type towers. Ice can also accumulate on the antennas themselves, and the additional ice load must be taken into account in the structural design of the tower, the antennas and the antenna mounts. Furthermore, when the tower is subjected to any wind load bending or swaying, or the metal warms slightly due to changed weather conditions, then the accumulated ice breaks off and falls down from the tower truss members. The falling ice is a significant hazard to any persons and equipment in the area at the base of the tower. Because this falling ice has been known to damage equipment shelters, it is therefore necessary to build the equipment shelters stronger to resist the icefall damage and protect the equipment within. Occasionally, cellular equipment shelters and the equipment housed therein are also damaged by gunshots fired at the cellular facility. Thus, it has become known to fabricate an equipment shelter in the manner of a cast concrete bunker to provide icefall and ballistic protection. Such a concrete bunker is extremely heavy, and requires specialized heavy lift crane equipment or heavy lift helicopters for placement on site.

In a separate field completely unrelated to the above discussed field of wireless communication via cell sites, namely in the field of long distance transportation of goods, it has become the internationally accepted standard to transport various and diverse goods packaged within standardized steel shipping containers as freight or cargo on ships, trucks and railway trains (and even in aircraft). A standardized system has been developed, so that such a standardized shipping container can easily and efficiently be loaded, handled, transferred between, received in or on, and transported by such ships, trucks and trains that have been adapted according to the standards. In view of the different modes of transport, such containers are also known as intermodal shipping containers. Such shipping containers are available in standardized sizes having lengths of 10 feet, 20 feet, 40 feet, 45 feet, 48 feet and 53 feet, widths of 8 feet and 8 feet 6 inches on the outside, and heights of 8 feet 6 inches and 9 feet 6 inches. A standardized shipping container typically has a corrugated steel ceiling, floor, longitudinal side walls, and front end wall, as well as outwardly swinging double loading doors on the back or rear end. A flat steel or wooden load floor may be provided inside the container. The structure is welded together to provide a structurally strong and weather-tight enclosed container. All eight corners are provided with so-called twist-lock points that represent load bearing and load transfer points as well as securing or fastening points at which containers may be coupled, engaged, lifted, or stacked on each other in a secured and load transmitting manner. These are also the points at which a container is coupled on a flatbed truck or tractor truck, a railway train bed, or a ship cargo hold. The containers are longitudinally strong to withstand the arising bending loads of the container itself and the cargo load therein when the container is lifted by lifting points at the ends thereof or at provided fork lift slots. In this regard, the two longitudinally extending edges along the floor of the container are reinforced by continuous steel C-channel beams, and the two longitudinally extending edges along the ceiling of the container are reinforced by continuous steel square-sectional beams. Also, the containers are sufficiently strong in the height direction, against crushing or buckling, so that several containers can be stacked one on top of another. In this regard, the four vertical edges of the container are reinforced with steel posts at all four corners.

A given shipping container is often used several times for bi-directional shipping of different goods back and forth between two locations, or for sequential shipping of different goods from point A to point B, then from point B to point C, then from point C to point D, and then perhaps back to point A. However, when the balance of trade, or especially the balance of shipments into and out of a given location is unbalanced and involves a greater number of inbound shipments than outbound shipments, this results in stockpiling of empty shipping containers at such a location. Because new shipping containers can be purchased quite cheaply in some countries having a high net exporting balance of trade, such as China, it is cheaper and simpler to purchase a new shipping container for import shipping further cargo, rather than return-shipping an empty container back to such a country (e.g. China) for re-use. As a result, empty used shipping containers are being stockpiled in some locations in the United States, and are available cheaply as scrap steel, or for recycling, upcycling, reuse or refabrication.

It is becoming known to use such steel shipping containers as core structures for various buildings, such as storage sheds, mobile restaurants, camping cottages, and even as apartments, hotels and individual private residence homes. To modify or re-fabricate a shipping container for such uses, it is known to cut openings for doors or windows in the steel walls of the shipping container and to provide suitable interior finishes, fittings and furnishings for the intended use. Moreover, such applications make use of the inherent structural strength of the shipping container for carrying bending loads along the horizontal lengthwise axis thereof, and vertical compressive loads along the four vertical edges thereof. Because of the standardized sizes of the available shipping containers, clusters of such shipping containers can be grouped or arranged modularly to form a repetitive housing structure such as an apartment complex, or can be modularly interconnected to construct a larger building having an overall configuration made up of several interconnected shipping containers. In view of such building structure applications of shipping containers, these standardized containers are also known as Intermodal Steel Building Units (ISBU) or ISBU shipping containers.

SUMMARY OF THE INVENTION

In view of the above, it is an object of the invention to provide a structure for a cell site, which serves simultaneously as a tower for mounting cell antennas or other antennas at a sufficiently high location, and as an equipment shelter or enclosure to house and protect the cell base station equipment and other associated electronic equipment, whereby this structure shall be easily and quickly fabricatable and deployable, acceptable to communities, local ordinances and building codes, structurally strong and weather-tight, and deployable at a lower cost and lower weight than conventional towers and equipment shelters. Another object of the invention is to provide a novel re-purposing and re-use of standardized ISBU shipping containers. Another object of the invention is to provide a method of fabricating and deploying a cell site including a tower structure and an equipment enclosure. The invention further aims to avoid or overcome the disadvantages of the prior art, and to achieve additional advantages, as apparent from the present specification. The attainment of these objects is, however, not a required limitation of the claimed invention.

The above objects have been achieved according to the invention in an antenna tower structure, also referred to as a cell site structure or a communications structure, as well as a method of deploying or erecting such a structure.

One aspect or embodiment of the invention provides a combination of structural components that are fabricated, configured and adapted to be assembled and erected to construct an antenna tower structure. This combination of components includes a tower structure that is to be erected with its longitudinal axis standing upright or vertically on a suitable foundation, and an antenna cupola that is to be mounted on top of the tower structure. The tower structure comprises, as a structural shell, a standardized steel shipping container, e.g. an ISBU shipping container, which has been modified with one or more of the following modifications: extra longitudinal reinforcement members have been secured along at least two of the longitudinal edges or beams of the shipping container; mounting hardware has been provided at one longitudinal end of the shipping container adapted to be mounted on the foundation; mounting hardware has been provided on the opposite longitudinal end of the shipping container adapted to have the antenna cupola mounted thereon; an access opening has been cut in the second longitudinal end of the shipping container to allow access from the tower structure into the antenna cupola by personnel for installation, inspection, maintenance etc.; and at least one access door has been mounted in an opening cut into one of the four large sides of the shipping container (i.e. the original lengthwise sides, top or bottom of the shipping container, respectively forming the four upright sides of the tower structure in the upright erected condition).

Another embodiment or aspect of the invention is directed to a method of erecting an antenna tower structure or cell site structure or communications structure including steps of placing a foundation at a selected tower location, obtaining a tower structure based on a standardized shipping container having modifications as mentioned above, obtaining an antenna cupola, erecting the shipping container on the foundation such that the shipping container stands upright with its longitudinal axis extending substantially vertically or upright, and mountingthe antenna cupola on the upper longitudinal end of the shipping container which is nowthe upper end of the tower structure.

A further aspect or embodiment of the method adds steps relating to performing the modifications on a standardized shipping container to fabricate the tower structure. Further embodiments or aspects of the method include steps of mounting at least one antenna in at least one antenna stage or level forming at least one rad center in the antenna cupola, installing base station equipment and/or other electronic equipment in the tower structure, and electrically connecting the antenna to the equipment.

Further detailed or preferred embodiments of the invention provide the following additional features individually or in any combination thereof. Preferably at least one floor is constructed and installed in the shipping container, with the plane of the floor extending normal or perpendicularly to the longitudinal axis of the shipping container. The floor divides the space within the shipping container into at least one equipment stage and at least one tower access stage above the equipment stage. A second floor can be provided to form another equipment stage. Each equipment stage can thereby be enclosed or substantially enclosed to allow this space to be climate controlled as necessary for the electronics equipment installed therein. Also, one or more floors and/or interior walls can divide the interior spaces from one another to allow independent secure access to the separate spaces, for example by different wireless service providers, so that one equipment stage can house the equipment of a first wireless service provider while the second equipment stage can house the equipment of a second wireless service provider, and each wireless service provider will have access only to its own equipment in its own equipment room. In this regard also, a second exterior access door can be provided through a wall of the tower to provide exterior access to the second equipment stage. Furthermore, a ladder or stairway extends from one or more equipment stages up to the antenna cupola, preferably internally in the tower through the tower access stage, but alternatively or additionally on the outside of the tower. A weather-tight access hatch is preferably provided to cover and close the access opening at the top of the tower structure, with the access ladder leading from the equipment stage(s) up to the access hatch. This ensures that the interior of the tower structure is completely weather-tight without allowing the penetration of any rain, snow or the like from the outside. The term weather-tight does not require that the entire interior space of the shipping container is air-tight or even water-tight, but rather that at least the equipment installation locations are sufficiently protected from penetration by water, snow or other moisture, through the use of suitable flashing, sealing, baffling etc. of any openings of the outer container envelope, so that the interior space can be certified as a weather-protected interior space suitable for installation of indoor-type electronics equipment. Furthermore, the interior of the tower structure is preferably insulated, most preferably with spray foam insulation, after the steel walls of the shipping container have been furred or strapped with wooden studs, and then interior sheathing and interior paneling is preferably secured on the studs. Thereby, the interior spaces of the equipment stage and the tower access stage present a clean uncluttered appearance and working space, the interior sheathing and studs provide easy and rugged mounting points for mounting the electronic equipment, hardware racks, electrical cable conduits and raceways, etc. The insulation avoids the formation of condensation on the inner wall surfaces or on the inner surfaces of the shipping container walls, and makes it easier to heat or cool the interior space as required for the electronic equipment, by means of installed heating, ventilation and/or air-conditioning equipment. As a further preferred but optional feature, ballistic protection panels can be mounted on all interior or exterior wall surfaces, or at least in the equipment stage or critical areas thereof, to provide protection of the electronics equipment against gunshots or the like fired at the tower.

The antenna cupola provides at least one antenna stage or level in which at least one rad center including at least one wireless communication antenna can be mounted in a clear open space under a roof. To avoid any reflection, scattering or other signal degradation of the antenna beam, the cupola structure is preferably entirely or substantially made of non-metal materials. Particularly, a structural frame of the cupola is preferably non-metallic and especially made of composite material such as fiber reinforced plastic composites. The roof on top of the cupola protects the antenna and at least a portion of the top of the tower structure from ice, snow and rain. The cupola may further include a clock stage with a clock and/or a bell stage with a bell, and further provide non-metallic shutters or other cladding covering the openings of the antenna stage. Thereby, the cupola can be given the outward appearance of a common or conventional ventilation cupola, bell tower, clock tower, steeple or the like. Furthermore, the exterior of the cupola and the exterior of the entire tower structure can be covered with essentially any desired facade cladding, such as wood siding, vinyl siding, metal siding, brickwork, stonework, stucco, concrete blocks, tiles, asphalt shingles, clay tiles or pavers, etc., so that the entire antenna tower structure is camouflaged to blend-in with surrounding buildings or architectural styles. This is true even with respect to historic buildings under historic building preservation constraints. Any desired cladding material can be installed on the tower structure in any conventionally known manner directly on the steel exterior of the shipping container. Alternatively, wood or composite furring strips can be mounted (e.g. screwed or adhesive bonded) on the steel exterior of the shipping container, and the facade cladding can be mounted on the furring strips. As a further alternative, pre-fabricated facade cladding panels can be mounted (e.g. with screws) onto the steel exterior of the shipping container or onto furring strips. For example, the desired exterior cladding can be pre-mounted on 4'×10' sheets of exterior grade plywood that have been cut to size, and then these pre-fabricated cladding panels can simply be screwed onto the exterior of the shipping container, with appropriate trim (e.g. corner boards and battens) and/or sealant materials to cover the joints or seams between adjacent panels. This allows for very rapid and cost-effective cladding of the exterior of the tower structure once it has been erected. In the above manners, the tower's appearance can especially be matched to that of a building adjacent to the tower. The tower may also be structurally attached to the adjacent building, for additional lateral support and stability. Also in this regard, the tower can house a stairwell or an elevator shaft or the like, which services the adjacent building.

The overall antenna tower structure can include only a single upright standing shipping container, or can include plural shipping containers. For example, to achieve a greater height, two shipping containers can be mounted vertically one on top of the other. As a further alternative, a first horizontal shipping container forms a base, and a second vertical shipping container is erected on top of or next to the horizontal shipping container. Thus, when a shipping container is described herein as standing "on" a foundation, it should be understood that the shipping container may actually be standing indirectly on the foundation, in that another shipping container is interposed between the first shipping container and the foundation. Still further, a third shipping container can be provided horizontally under or next to the vertical shipping container, or a third vertical shipping container can be arranged next to a second vertical shipping container. Such configurations provide additional height for the tower, additional stability against wind loads and other tilting or shear forces on the tower, and also additional easily accessible equipment space for sheltering the required electronics equipment associated with the antenna or antennas mounted in the antenna cupola at the top of the tower. These various arrangements also demonstrate the modularity achieved by use of standardized shipping containers to build the tower structure.

With the above features, the invention is able to achieve significant advantages in comparison to the prior art. Due to the re-use of existing standardized shipping containers, the tower structure can be fabricated quickly, modularly, and relatively inexpensively. Also, the shipping containers are pre-engineered and provide substantial structural strength as well as a weather-tight outer shell. It is also easy and inexpensive to ship the tower structure components from a fabrication facility to any installation site because the tower sections based on standardized shipping containers can be easily shipped on any truck, train or ship that is outfitted for handling standardized shipping containers. The tower sections based on shipping containers are also lighter than some other equipment shelters (such as concrete bunker-type shelters) and are therefore easier to erect or place on site by lighter-duty cranes or helicopters, in comparison to such heavier equipment shelters.

The use of a separate tower structure for mounting antennas and sheltering associated equipment avoids the problems that arise when trying to mount antennas or shelter equipment on or in existing buildings. There is no need to structurally alter and reinforce an existing building, and the waterproof roof membrane of any existing building is not threatened. There is also no issue of ownership or leasing space in the existing building. Purchasing or leasing the necessary land for the footprint space of the tower's foundation and access area are generally much easier and less expensive than purchasing or leasing space in and on an existing building. Furthermore, because the outside of the tower structure can be cladded or finished to match any existing adjacent building, the tower structure will blend-in with its surroundings and therefore be readily acceptable to community members, and will also be easy to obtain the necessary building code or local zoning ordinance permitting. Furthermore, the tower adjacent to a building can provide benefits to the building owner and occupants, for example a stairwell or an elevator shaft for the building can housed within the tower. Still further, the owner of the tower obtains a revenue stream by renting-out space in the antenna cupola and/or equipment stages to wireless service providers. Thus, because the tower "pays for itself" and is not visually objectionable, it becomes advantageous for a municipality to add a bell tower or clock tower to a municipal building, for example, or for a church to add a steeple or bell tower to a church that otherwise would not have one. Still further, because two or more equipment stages with separately accessible equipment rooms can be provided in the tower structure, a first wireless service provider that owns or leases the entire tower structure can sub-lease some of the space to secondary wireless service providers, so that the tower also provides a revenue stream to the owner or primary lessee. Once again, over time the tower structure "pays for itself".

Because of the inherent structural strength of the steel shipping container, and because additional longitudinal reinforcement can easily be added as needed based on the engineering specifications for a particular installation, tower structures according to the present invention are suitable for class I, class II and class Ill tower installations, and can be suitably designed for all exposure categories B, C and D, and all topographic categories 1, 2, 3, 4 and 5. The inventive tower structure is also suitable for installation in earthquake-prone areas with appropriate engineering design of the extra reinforcement added to the shipping container, of the foundation, and of the connection or mounting of the tower on the foundation. Furthermore, because the climbing facility, particularly the ladder or stairway for climbing from the equipment stage(s) to the antenna cupola is an interior ladder enclosed within the weather-tight interior of the tower structure, this will easily satisfy all climber safety standards. Still further, because the interior equipment rooms are completely weather-protected and preferably also climate controlled, it is possible for the wireless service provider to install interior-type electronics equipment, rather than needing to use much-more-expensive exterior-type equipment or self-contained exterior equipment packages or units that include their own sheltering cabinet or enclosure, exterior-rated electronics, power, and climate control systems.

Furthermore, the roofed antenna cupola of the present inventive tower structure provides weather protection for the antennas, and especially helps to avoid the accumulation of ice and snow. The optional shutters or other concealment panels over the openings of the antenna stage of the antenna cupola provide additional weather (ice, snow, wind, etc.) protection. This allows antennas and antenna mounts with lower structural strength ratings to be used. Also, the present tower does not suffer ice accumulation problems like conventional lattice-type antenna towers and thus there is no danger or strongly reduced danger of ice sheets, ice spears or icicles separating and falling from the tower and threatening persons, equipment and an equipment shelter below the tower.

BRIEF DESCRIPTION OF THE DRAWINGS

In order that the invention may be clearly understood, it will now be explained in further detail in connection with several example embodiments thereof, with reference to the accompanying drawings, wherein:

FIGS. 22A, 22B, 22C, 22D, 22E and 22F include schematic elevation and plan views showing details for the construction and erection of a first example configuration of a tower according to the invention.

DETAILED DESCRIPTION OF PREFERRED EXAMPLE EMBODIMENTS AND THE BEST MODE OF THE INVENTION

Figures 1, 2:
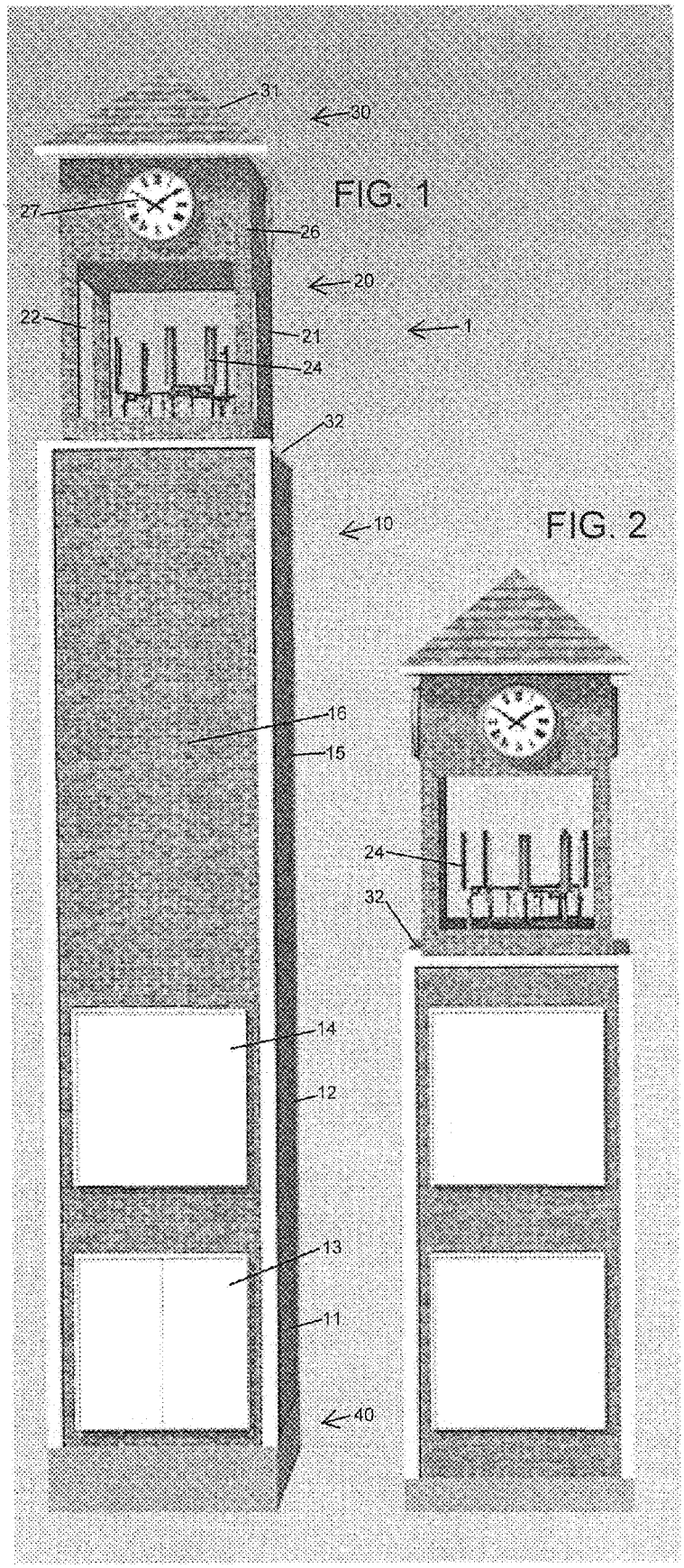
FIG. 1 is an exterior frontal perspective view of the design appearance and structural configuration of a first embodiment of an antenna tower structure according to the invention.
FIG. 2 is a view similar to FIG. 1 but showing a second embodiment of the antenna tower structure according to the invention.

As shown in FIG. 1, for example, a cell site structure or antenna tower structure 1 according to the invention generally includes a tower 10 mounted on a foundation 40, and carrying an antenna cupola 20 on top of the tower 10. The antenna cupola 20 includes a cupola frame structure 21 that is preferably constructed of non-metallic materials, and most preferably completely of composite materials, so that the cupola frame structure 21 does not cause any reflection, blocking, interference or other degradation of the wireless signals of one or more antennas 24 mounted in at least one antenna stage 22 of the antenna cupola 20. This single antenna stage or first antenna stage 22 has large openings respectively between four cupola legs of the frame 21 at the corners forming the perimeter of the cupola, to provide unobstructed beam patterns, preferably in all four directions, for the antennas 24 forming one or more rad centers in the antenna stage 22. The antennas 24 may be any type of wireless transmitting, receiving or transceiving antennas, such as for providing wireless communication such as cell phone communication, or microwave transmission, or any other type of antenna.

Above the antenna stage 22, the cupola frame structure 21 carries at least a roof 30 that provides weather protection for the antennas 24. Optionally, the antenna cupola 20 further may include another stage such as a clock stage 26 with one or more clocks 27, arranged below or above the antenna stage 22. This clock stage 26 provides additional functionality and also the typical acceptable appearance of a clock tower. In this regard also, the roof 30 may be finished with any suitable roofing material 31 such as shingles to match or blend-in with any surrounding or adjacent buildings. Similarly, the antenna cupola 20 can be clad with a facade cladding 16 that matches or blends-in with the cladding of any nearby or adjacent building.

Preferably the entire antenna cupola 20 or at least its structural frame is fabricated of non-metal materials, and preferably of composite materials. Thereby the antenna cupola will not interfere with the antenna transmission or reception. The cupola 20 is also preferably constructed modularly, so that different combinations of stages can be combined as required for any particular installation. For example, FIG. 1 shows a clock stage 26 mounted above an antenna stage 22, but as will be discussed below, various different stages can be combined in a mix-and-match fashion for various different installations.

The tower 10 shown in FIG. 1 has a structural shell fabricated by modifying a standardized forty foot shipping container, which is then erected to stand with its longitudinal axis substantially vertically on the foundation 40, to provide a tower height of about forty feet for mounting the antennas 24 in the antenna cupola 20. The tower 10 provides a weather-tight enclosure therein, which can be divided into several stages as follows. For example, a first equipment stage 11 accessible through a first stage access door 13 and a second equipment stage 12 accessible through a second stage access door 14 can each house base station equipment and/or other electronic equipment associated with the operation of the antennas 24. The doors 13 and 14 provide easy access for initially bringing in and installing the equipment, and later for maintenance or replacement of the equipment. While FIG. 1 shows the equipment access doors 13 and 14 as respective double doors, alternatively a single panel or single leaf door may be installed (for example see FIGS. 22F, 23B, 23C and 23D). For convenience, each access door is preferably a door with a vertical hinge, i.e. with the hinge axis parallel to the longitudinal axis of the shipping container. A suitable opening is cut through the steel wall of the shipping container, a steel door frame is welded in place, and a steel door panel or panels are mounted by hinges in the frame. The tower further encloses a tower access stage 15 above the equipment stages and leading up to the antenna cupola. As will be described below, the tower access stage 15 preferably includes a ladder or a staircase for easy, safe weather-protected climbing access to the antennas 24. Each equipment stage 11 and 12 may comprise an independent equipment and work room, with preferably a ceiling height of approximately ten feet and interior floor dimensions of about seven or eight feet by about eight or nine feet. In addition to having the electronics equipment mounted therein, each equipment stage may have a work table, a chair or stool, shelves, cabinets or the like installed therein. This provides a convenient, secure space for personnel to install, test, inspect and maintain the electronics equipment, with 24/7 exterior access. Electric lighting is also installed in all of the interior stages of the tower and in the cupola. Through the use of additional interior partition walls, fences, gates or the like, the two equipment stages 11 and 12 can be separated and secured from one another, either with or without access to the interior ladder that extends through the tower access stage 15 to reach the antenna cupola 20. Thereby, more than one service provider can have their equipment housed securely within the tower 10, while ensuring that other parties cannot access their equipment.

Just like the antenna cupola 20, the tower 10 preferably has an exterior facade cladding 16 applied thereon, preferably to match the appearance of any nearby or adjacent building, and/or as specified by local ordinances or other requirements. As discussed above, any conventional exterior facade cladding can be installed in the conventional manner on the steel exterior of the shipping container, or pre-fabricated panelized facade cladding can be very easily and rapidly installed by simply screwing, hanging, latching, clipping, adhesive bonding (or any other known attachment methods), the pre-fabricated panels onto the longitudinal edge members and/or the wall surfaces of the shipping container, and then applying appropriate trim members and/or sealant along any joints between panels. The top of the tower 10 is provided with a weather-tight top or ceiling 32 where the antenna cupola 20 mounts on the top of the tower 10. Also, a weather-tight access hatch is provided as will be discussed below. Furthermore, if the tower 10 is structurally secured to an adjoining building, the entire junction between the tower and the building is appropriately flashed and sealed with weather-tight sealant materials to avoid the penetration of water or the like.

The foundation 40 is any suitable foundation base that is engineered to provide the required vertical compression load support and the required support for all torsional, tilting, bending and/or shear loads on the tower. For example, the foundation 40 may comprise a poured concrete slab, poured concrete frost walls or foundation walls on suitable footings, and/or piers on suitable footings. Alternatively, pre-fabricated foundation members may be used, such as pre-cast piers and footings placed in holes supported by undisturbed native soil of sufficient compressive strength bearing capacity. The top of the foundation is preferably provided with anchor bolts anchored in the foundation, so that the base of the tower 10 can simply be bolted down onto the foundation 40.

Preferably, the rear end of the shipping container that was originally provided with container loading doors will become the bottom end or base of the tower 10. In fabricating the structural shell of the tower, the shipping container is modified by cutting and removing the shipping container doors, and welding mounting hardware such as mountingflanges, mounting brackets, a connecting plate and/or a mounting base on this end of the shipping container. Such a mounting flange 39 is schematically shown in FIGS. 3, 4, 22A and 22B. The mounting hardware may also include alignment studs and/or alignment holes that help to align components with one another as they are lifted into place with a crane or the like while the tower structure is being erected. The foundation 40 preferably is provided with anchor bolts that are anchored in the concrete at specified locations, so that the bolts pass through corresponding holes or slots in the mounting flange 39, whereupon the shipping container is secured onto the anchor bolts by suitable nuts.

The opposite front end of the shipping container, which is typically a closed end without doors, becomes the top 32 of the tower 10. In this regard, the same mounting hardware such as a mounting flange 39 is also welded into place at the upper end 32, so that the antenna cupola 20 can be secured onto the tower 10 by suitable bolts and nuts via the mounting flange. This consistent or matching use of mounting hardware on the opposite ends of the shipping container (or also on sides of the shipping container as will be discussed below), allows a modular construction method in which several shipping containers can be connected together to form larger tower structures, as will be discussed below.

Such a modular construction allows all of the different available sizes of standardized shipping containers to be used individually or in different combinations to fabricate suitable antenna tower structures for different requirements. For example, while FIG. 1 shows a tower 10 based on a single forty foot shipping container, FIG. 2 shows a shorter tower that is based on a twenty foot shipping container, but that is otherwise similar to the taller tower of FIG. 1. Due to the availability of different sizes of shipping containers, this makes it possible to easily, modularly adapt the present inventive components and techniques to tower structures of any required size.

Figure 3:
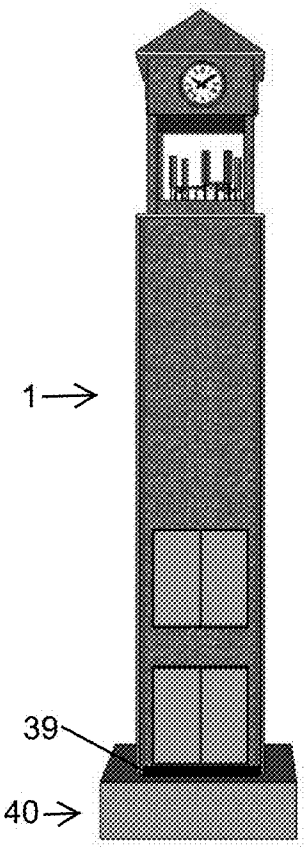
FIG. 3 is a front elevation view similar to FIG. 1, of the first embodiment of the antenna tower structure, but with a different foundation base.

FIG. 3 shows an antenna tower structure similar to that of FIG. 1, but having a somewhat larger foundation 40. For example, the foundation may have a larger footprint to provide greater support to withstand greater lateral loads such as wind loads or the like on the tower, or due to a lower inherent compressive strength of the native soil at the location. Or, the foundation 40 in FIG. 1 may be designed and engineered to support a tower that will additionally be secured to an adjoining building, while the larger foundation 40 in FIG. 3 may be designed and engineered to support the tower as a free-standing tower.

Figure 4:
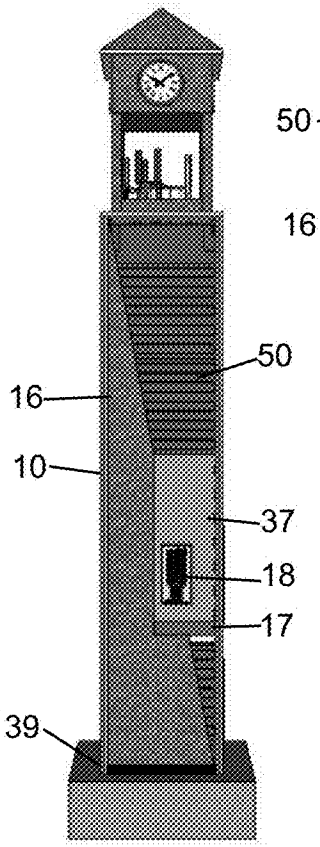
FIG. 4 is a view similar to FIG. 3, but showing the exterior facade cladding and a portion of a wall cut-away to show the standardized shipping container forming the structural shell of the tower, and components within the tower.

FIG. 4 shows a cut-away view of the tower of FIG. 3. Thereby, with the exterior facade cladding 16 partially cut-away, it can be seen that the structural shell of the tower 10 is formed by a single forty foot standardized shipping container 50 erected so that its longitudinal axis stands substantially vertically. In this disclosure, the term "substantially vertically" means vertically within the range of deviation that is acceptable for the tower installation.

Figure 5:
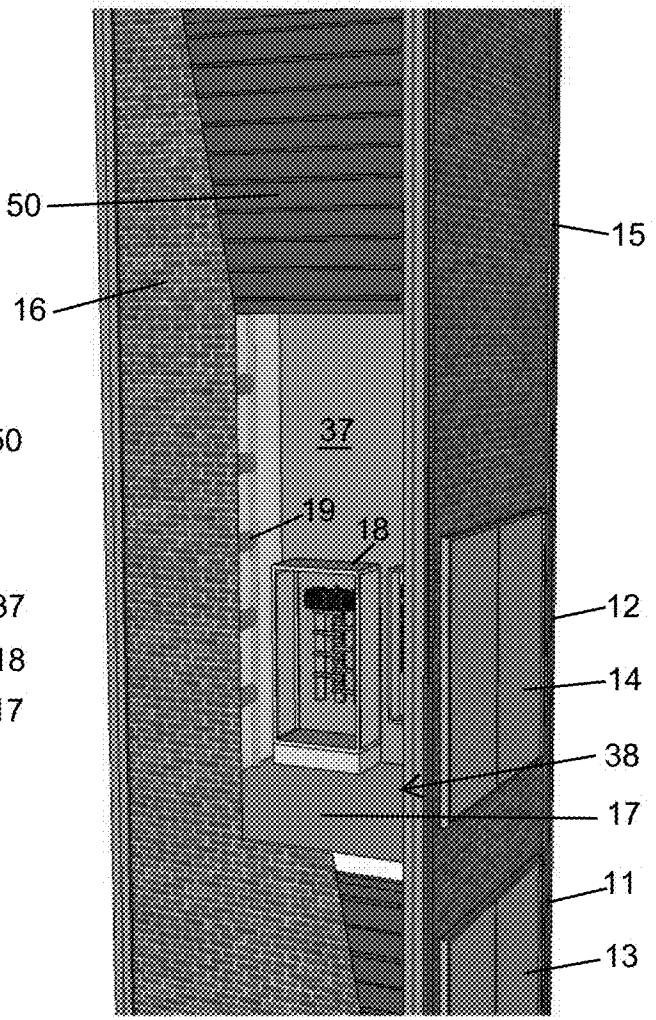
FIG. 5 is an enlarged detail view of a portion of FIG. 4, to show further details of the interior outfitting of the tower.

The cut-away of FIG. 4 and the enlarged detail view of FIG. 5 further show that at least one floor 17 has been constructed and installed extending transversely in the shipping container. Namely, the floor 17 extends along a plane perpendicular or normal to the longitudinal axis of the shipping container. The floor 17 is constructed of wooden floor joists or metal floor beams covered with wooden floor sheathing or metal plating, and may optionally be finished with any desired flooring material, such as linoleum, vinyl, cork, tile, wood, commercial carpet, or the like.

Also schematically shown in FIG. 5 is an equipment rack or cabinet in which base station equipment or other electronics equipment 18 is installed. Not shown are the conduits and raceways in which electrical cables are installed to connect the electronics equipment 18 with the antennas 24 in the antenna cupola 20. Still further, a ladder 19 or staircase is installed in the container to extend from the equipment stage 12 to the antenna cupola. A separate ladder with its own enclosure or partitioning can be provided to extend from the lower equipment stage 11, or both equipment stages 11 and 12 can share the same ladder 19 for access to the antenna cupola. As a further alternative, a ladder or stairway may be provided on the outside of the container. The ladder or stairway extends in the longitudinal direction of the container, which does not require the ladder or stairway to be strictly parallel to the longitudinal axis of the container, but merely means that the ladder or stairway generally proceeds in the longitudinal direction.

Figure 19:
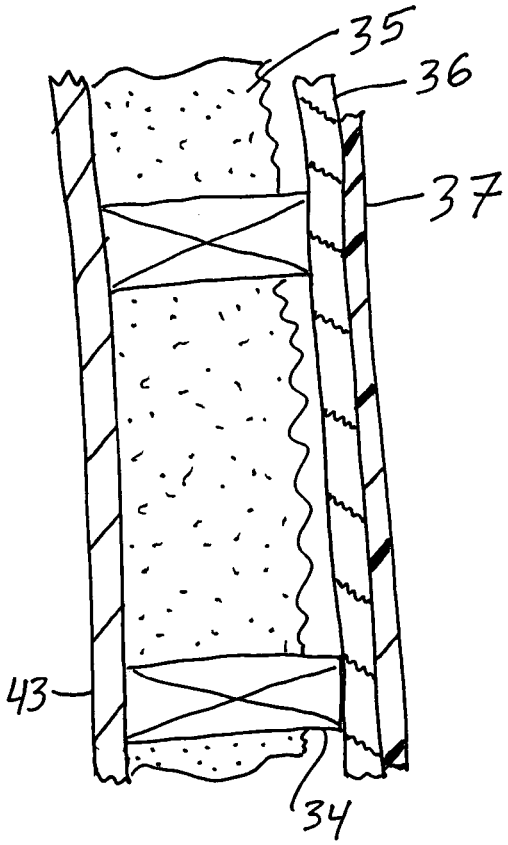
FIG. 19 is a schematic cross-sectional sketch through the wall of the tower structure.
Figure 20:
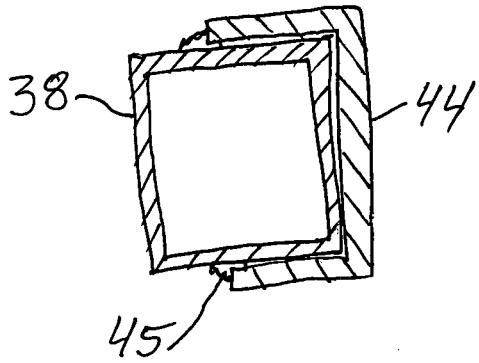
FIG. 20 is a schematic cross-sectional sketch showing extra longitudinal reinforcement of the shipping container.
Figure 21:
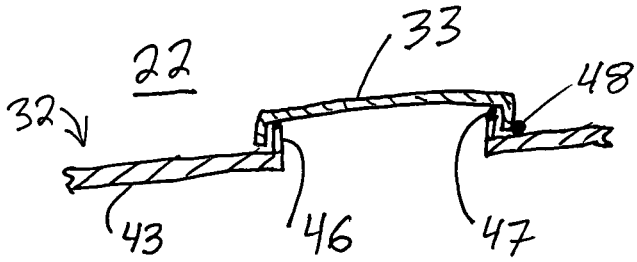
FIG. 21 is a schematic cross-sectional sketch of a weather-tight access hatch at the top of the tower.

Further details of some of the modifications carried out on the shipping container 50 for fabricating the structural shell of the tower 10 are schematically sketched in FIGS. 19, 20 and 21. The schematic FIGS. 19, 20 and 21 are not drawn to scale and are not drawn in proportion to the actual structural arrangements, but merely provide general schematic representation of the components. FIG. 19 shows that the interior of the steel wall 43 of the shipping container is preferably furred or strapped with wooden studs 34 preferably extending in the longitudinal direction of the container, and then interior sheathing such as plywood 36 is secured on the studs 34, and finally an interior paneling 37 such as plastic and/or metal paneling sheets are secured on the interior sheathing 36. These components can be fastened with any suitable fasteners, such as screws, and/or a suitable adhesive. As a further option, ballistic resistant protection panels can be mounted instead of or in addition to the plywood 36. The plywood 36 and studs 34 provide a convenient structural support for mounting any required equipment inside the tower structure, such as the electronics equipment 18 as well as any other hardware, fittings and furnishings. The interior paneling 37 provides a clean finished appearance to the equipment and workroom in the equipment stage, as well as the interior of the tower access stage. Providing a white or light color on the interior surface of the interior paneling 37 also provides a bright working environment to reduce the amount of electrical lighting that needs to be installed.

Further as shown in FIG. 19, depending on the climate of the installation location of the tower structure, the interior of the steel shipping container walls 43 may be insulated with any type of insulation 35, preferably spray foam insulation. Such insulation prevents the formation of condensation on the inner surface of the steel wall 43 or the interior paneling 37 at times when the exterior temperatures are colder than the interior temperature and especially the interior dewpoint. Additionally, if required, a vapor barrier may be installed. The spray foam insulation is preferred because it inherently also acts as a vapor barrier. The thermal insulation 35 further reduces the heating and cooling load for the installed climate control system, e.g. heating, ventilation and air-conditioning equipment (not shown). Thus, the required capacity or size of the installed HVAC equipment can be reduced and the ongoing operating expenses are also reduced.

An optional preliminary step is to thoroughly clean and strip the interior metal surfaces of the shipping container, for example with a chemical stripper or cleaning solution and a power washer or by sandblasting. This ensures the removal of any contamination by residue from prior shipments in a previously used container, and also prepares the metal surface to receive a coat of rust-inhibiting paint to seal the metal and prevent future corrosion. This is especially true if the particular installation will not require spray foam insulation.

FIG. 20 schematically represents one embodiment of reinforcement added to the shipping container to modify it for use as a tower structure. Namely, while a shipping container is inherently strong against bending for the cargo loads uniformly distributed throughout the shipping container, it has been found that the original structure of the shipping container is not strong enough with respect to bending, buckling and/ortorsion underthe vertical compressive tower load and additional lateral wind loading effects, when the shipping container is erected to stand upright as a tower that is merely mounted, supported and secured at its back door end on a suitable foundation 40 on the ground. Thus, it has been found that additional longitudinal reinforcement must be provided, particularly in the form of longitudinal reinforcement beams secured along the two longitudinal edges of the floor of the shipping container. The original structure of the shipping container includes a C-channel beam 44 extending continuously along each longitudinal edge of the floor side of the container. On the other hand, the ceiling side of the container includes a square-section beam extending along each longitudinal edge thereof. While the square-section beams of the ceiling edges have a smaller cross-sectional size than the C-section beams of the floor edges, the ceiling beams have been found to be stronger than the floor beams with respect to compressive, buckling and bending loads and oscillations to which the shipping container is subjected when oriented vertically as a tower. Thus, it has been found necessary to additionally reinforce the floor edge beams of the container, while the ceiling edge beams may be strong enough for certain tower installations, depending on the particular engineering requirements. One preferred manner of providing the required reinforcement is to weld a continuous longitudinally extending square-section hollow steel tube 38 into the existing C-channel member 44 of the shipping container extending longitudinally along each one of the longitudinal edges of the original floor of the shipping container. Preferably this involves a continuous weld 45 or the required placement of spot welds along the junction of the square tubular longitudinal reinforcement 38 and the C-channel 44. It is similarly possible, but not always necessary, to provide an additional reinforcement member extending along the other two longitudinal edges (the ceiling edges) of the container as well.

FIG. 21 schematically represents an example of a weather-tight access hatch 33 provided on the weather-tight top 32 of the tower 10. This is fabricated, for example, by cutting a suitable opening through the closed rear end wall of the shipping container, welding a metal frame and preferably a weather curb 46 around this opening, and then mounting the weather-tight access hatch 33 by a hinge 48 onto the steel end wall 43 of the shipping container. Furthermore, a weather-tight seal 47 such as rubber weather stripping or the like can be provided around the access hatch 33 to ensure that no rain or snow can penetrate into the interior of the tower structure.

FIGS. 22A, 22B, 22C, 22D, 22E, 22F, 23A, 23B, 23C and 23D show additional structural details in several views. For example, plan views in FIGS. 22A and 22B respectively show the configuration and provision of bolt holes and/or bolt slots as well as alignment holes in the top and bottom connector plates or mounting flanges 39. Another view in FIG. 22C shows the plan layout and configuration of a representative equipment floor 17 or platform support deck, with openings for personnel access via the ladder 19, as well as a cable or wiring access way. An elevation view in FIG. 22F shows the erected tower structure including the antenna cupola 20 mounted on the tower 10 based on a forty foot standardized shipping container. Three equipment stage floors 17 are indicated, as well as the longitudinal reinforcement 38, and further cross bracing or diagonal bracing 49 provided at each stage on each side of the tower.

The diagonal or cross bracing 49 may comprise steel angle members or channel members or square-sectional tubular members welded in place, or steel cables secured at corner points at the ends thereof. The diagonal or cross bracing, as well as the longitudinal reinforcements, are provided as necessary to reinforce the container to withstand the bending, twisting and shear loads and oscillations that will arise in the installed vertical orientation of the container as a tower, and to make up for any weakening of the original structure of the container due to the modifications that were made (e.g. cutting openings in walls thereof). The particular dimensions, configuration and construction of all of the bracing and reinforcing members depends on the design and engineering requirements for the particular tower installation, for example depending on expected or required wind load values, expected or required seismic activity values, the total height of the tower, the total height and weight of the antenna cupola with the installed antennas, the amount and weight of installed electronics equipment, etc.

FIG. 22F illustrates a tower configuration including a first shipping container 50 standing vertically on a second horizontally arranged shipping container 52. In the illustrated example, a forty foot shipping container 50 is standing vertically on a twenty foot horizontal shipping container 52. Because the shipping containers are originally designed and engineered to support vertical loads only at their ends, an additional longitudinal reinforcement 38' must be provided to properly carry and distribute the load of the vertical shipping container 50 onto the horizontal shipping container 52, and through the base container 52 into the foundation 40. FIGS. 22D and 22E are respectively a plan view and an elevation view of the additional longitudinal reinforcement 38' forming a so-called skid plate or skid platform. Furthermore, shims or extra mounting feet or pads 41 are positioned everywhere or especially at points of loading below the base container 52 so as to bear the loads downwardly into the foundation 40. Also, an extra optional transverse reinforcement 42 may be provided in the base container 52 in line with the wall of the vertical container 50 that is positioned above the hollow interior of the base container 52. This additional transverse reinforcement 42 may be in the form of a support frame or partial wall, or simply posts provided along the walls of the container. This transverse reinforcement 42 extends transverse to the longitudinal axis of the container 52, and vertically below the aligned wall of the vertical container 50.

Figure 23A:
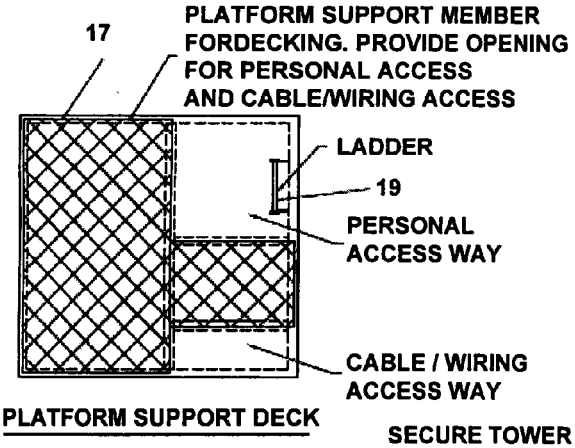
FIGS. 23A, 23B, 23C and 23D include schematic views showing details for the construction and erection of three further example configurations of towers according to the invention.
Figure 23B:
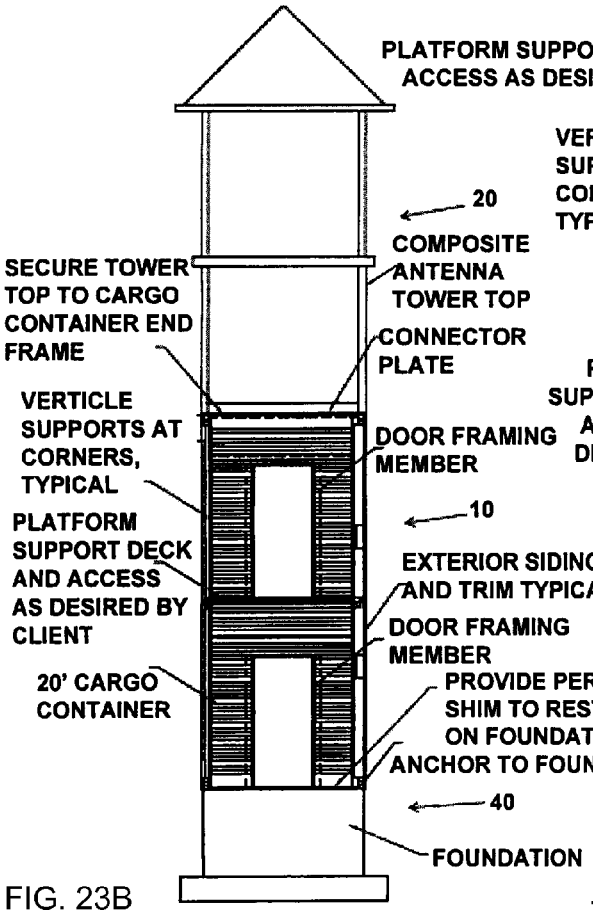
Figure 23C:
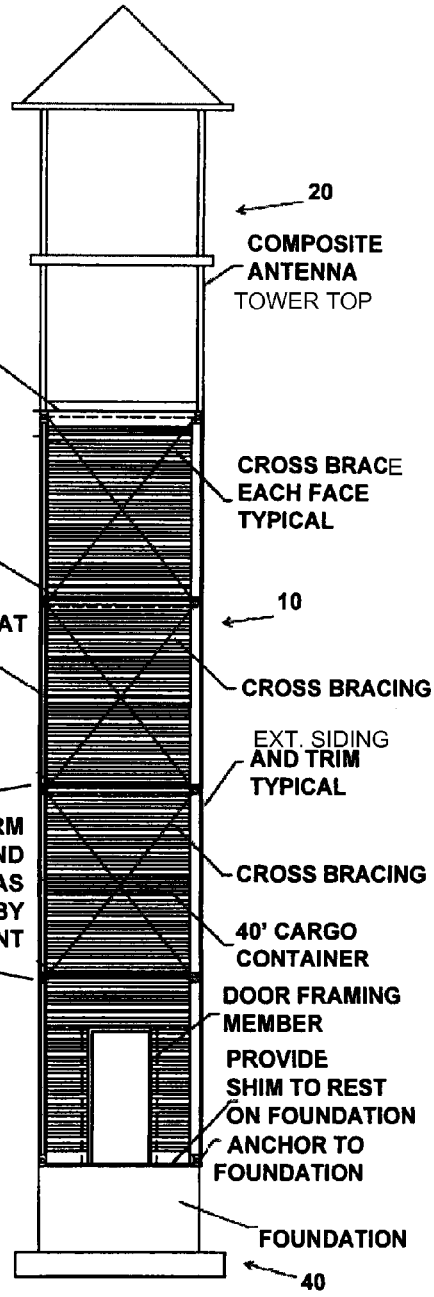
Figure 23D:
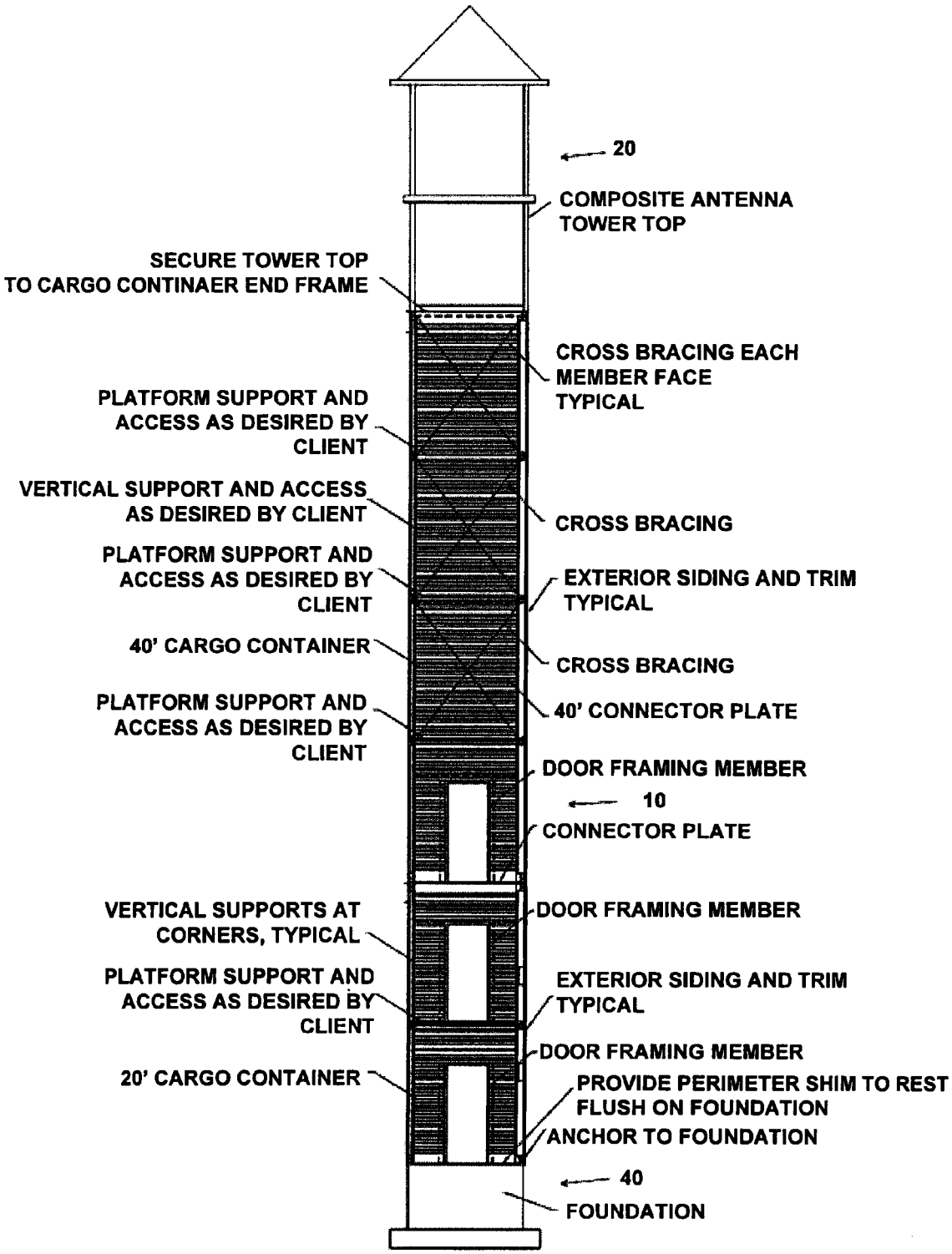

FIG. 23B shows a tower configuration with a single vertical twenty foot container, FIG. 23D shows a tower configuration with a forty foot vertical container stacked on a twenty foot vertical container, and FIG. 23C shows a tower configuration with a single forty foot vertical container. FIG. 23A shows a plan view of any one of these towers, similar to FIG. 22C discussed above. The details and components of these tower configurations can be understood in connection with the explanation of other drawing figures with similar or corresponding features.

Figure 6:
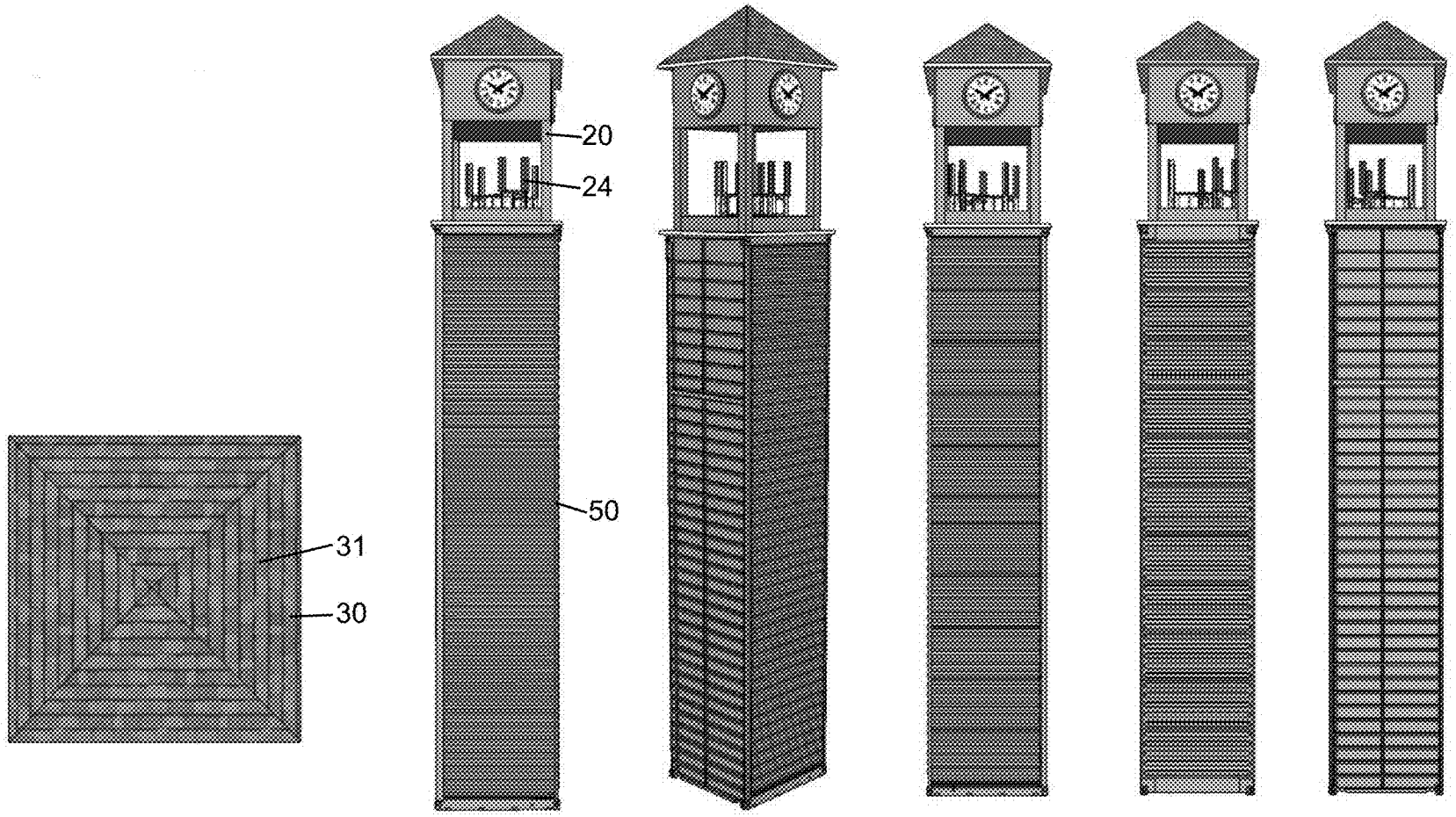
FIG. 6 shows a top view, a perspective view, and the four major side elevation views of an embodiment of a tower structure according to the invention, showing the design appearance and structure thereof before exterior cladding is applied, whereby the shipping container forming the structural shell is visible.

FIG. 6 shows the outer design appearance of the tower structure according to FIG. 1, before any exterior facade cladding is installed, and without the exterior access doors. Thus, the appearance of the shipping container 50 is clearly visible in a front view, back view, right side view, left side view, and perspective view. A top view shows the roof 30 with shingles 31, but it should be understood that the roof 30 can also be plane and unadorned or have any desired roofing material thereon. FIG. 6 thus shows the outer visual or ornamental design appearance of the tower at least during the construction or erection thereof, when the shipping container 50 has been erected into an upright vertical standing orientation and the cupola 20 has been mounted thereon, and the antennas 24 have been mounted in the cupola. Furthermore, instead of applying a facade cladding 16, it is alternatively possible to simply paint the exterior of the shipping container 50 in any desired color(s) and/or pattern(s). Thus, such a painted shipping container as the tower would also permanently have the appearance represented in FIG. 6.

Figure 7:
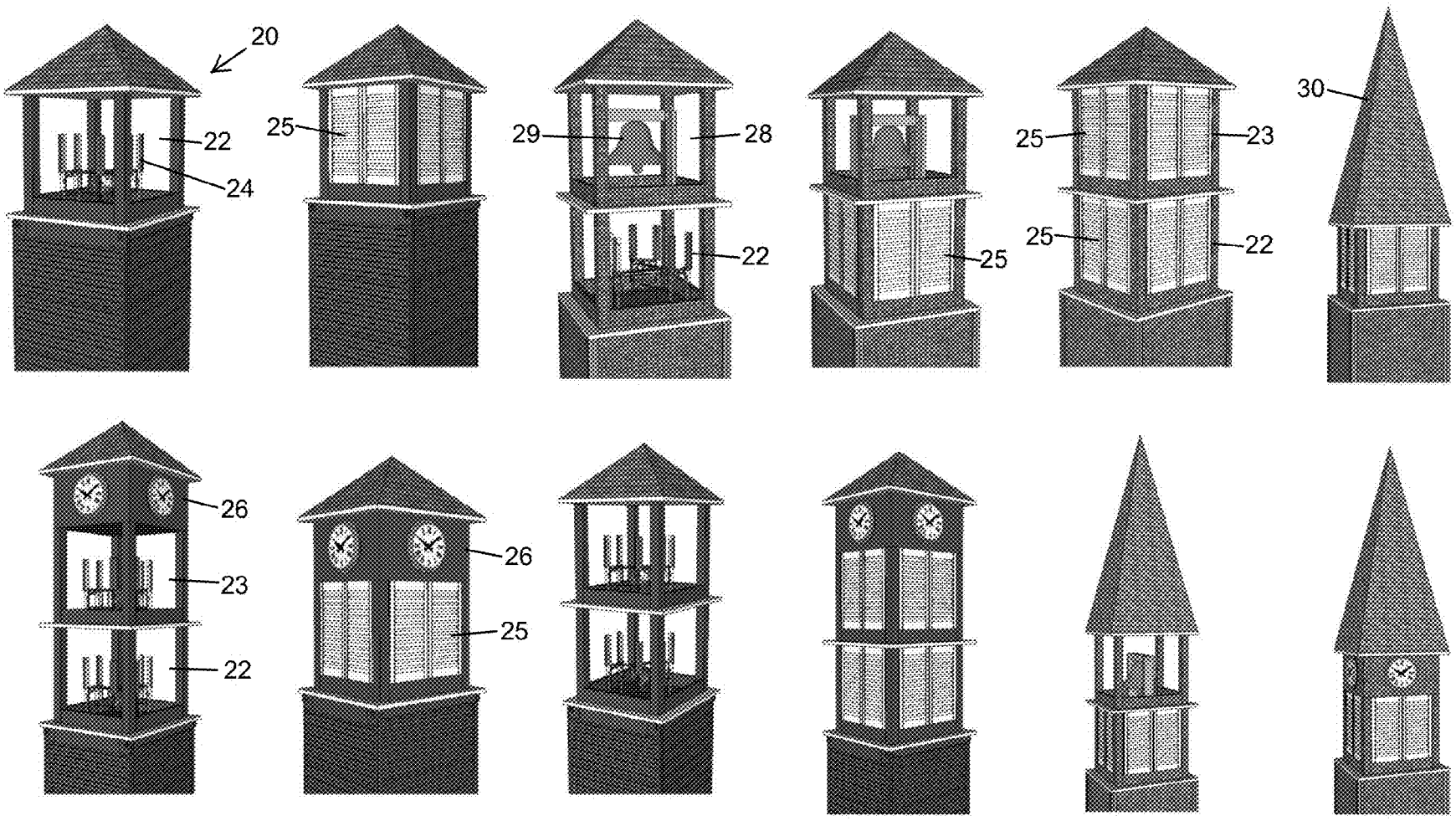
FIG. 7 shows several perspective views of various different configurations forming different embodiments of an antenna cupola according to the invention on top of the tower.

FIG. 7 shows several variations of the antenna cupola 20 that may be mounted on top of any one of the various configurations of the tower 10. Namely, any cupola configuration can be combined with any tower configuration in a mix-and-match manner. In fact, the cupola 20 has a modular construction, so that different levels or stages of the cupola can also be combined in a mix-and-match manner as desired. The top left view of FIG. 7 shows the cupola 20 with a single open antenna stage 22. The next view in FIG. 7 shows a similar cupola but additionally having shutters 25 installed to cover or enclose and thereby conceal the single antenna stage 22. In this regard, the shutters 25 are non-metallic such as wood or plastic or preferably composite. Alternatively, any other non-metal sheathing or plastic or glass windows can be installed to enclose the antenna stage, instead of the shutters 25. The shutters 25 or any other type of enclosure panels provide "stealth" concealment of the antennas 24 but also provide weather (ice, snow, rain and wind) protection for the antennas as well as protection against nesting birds and the like. With such protection, the antennas and mounts thereof do not need to be as strongly engineered as would otherwise be required.

The third view of FIG. 7 shows an antenna cupola with an antenna stage 22 arranged below a bell stage 28 with a bell 29. Thus, the antenna cupola and the antenna tower can be disguised as a bell tower. This becomes further apparent in the next view of FIG. 7, in which the antenna stage is concealed by shutters 25. The next view of FIG. 7 shows a lower antenna stage 22 and an upper antenna stage 23 both concealed by shutters 25. Thus, a tower with such an antenna cupola has the outer appearance of simply being a ventilation cupola or an enclosed bell tower or the like. The lower left view of FIG. 7 shows two antenna stages 22 and 23 topped by a clock stage 26. The next view shows a stage with shutters 25 topped by a clock stage 26. The subsequent views show additional possible mix-and-match configurations. The upper rightmost view and the two last views on the right of the bottom row of FIG. 7 show a cupola configuration with a steeper roof 30 more akin to a steeple such as a church steeple. It can be seen that the antenna cupola can be disguised with shutters or with a clock stage or a bell stage, to conceal the fact that it is actually a wireless communication antenna tower.

Figure 8:
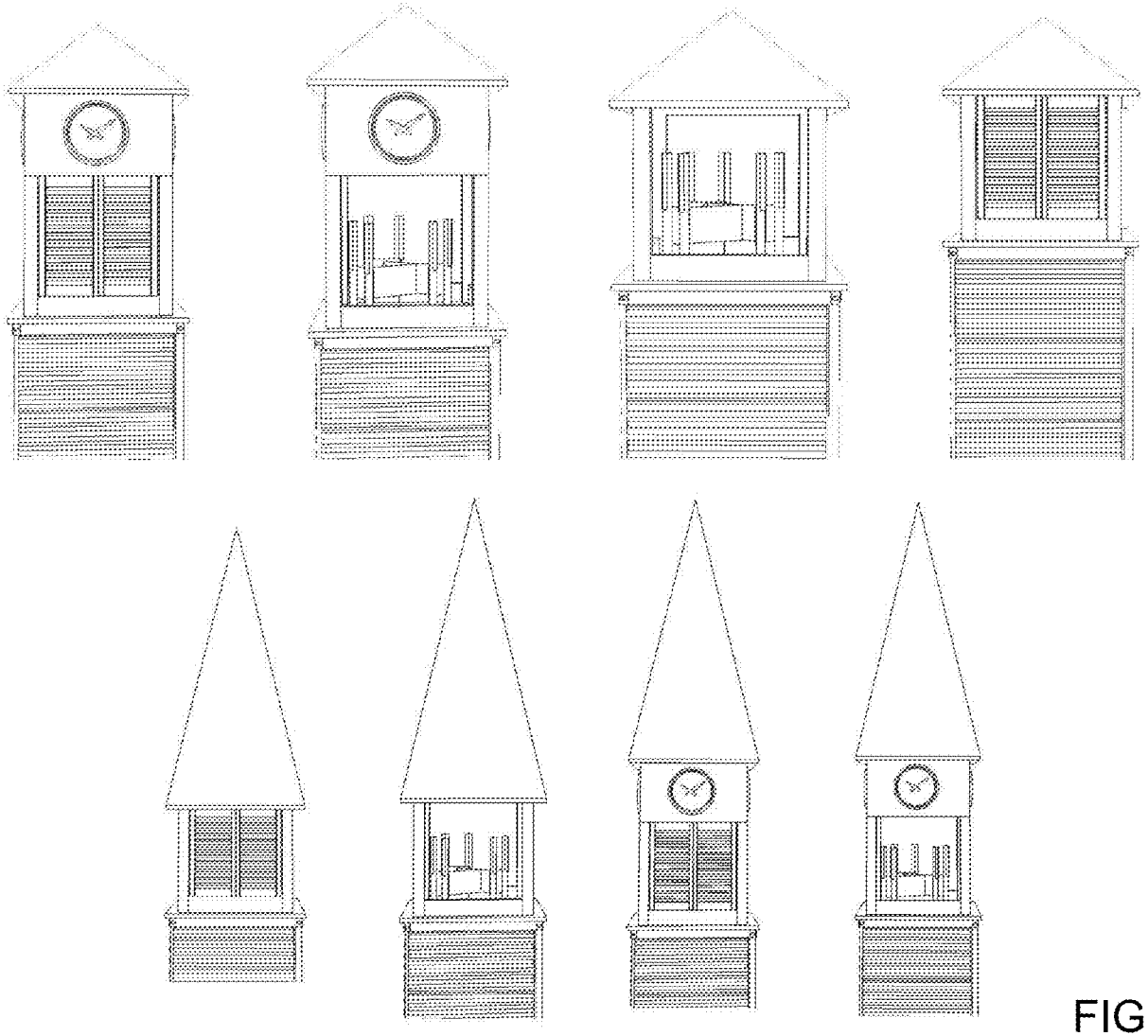
FIG. 8 shows several front elevation views of basic design aspects of several variations of antenna cupolas according to the invention.
Figure 9A:
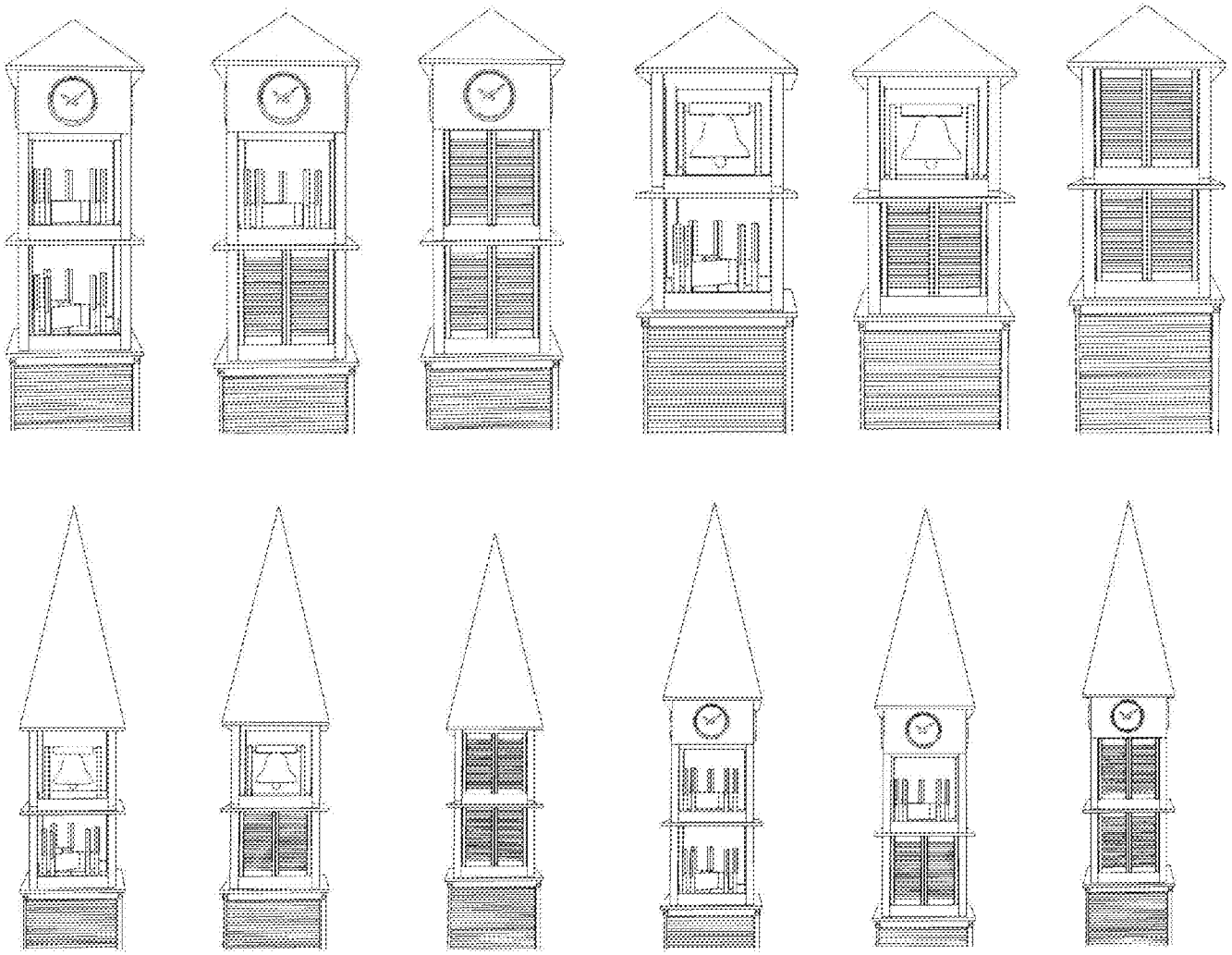
FIGS. 9A and 9B show several front elevation views of basic design aspects of several additional variations of antenna cupolas according to the invention.
Figure 9B:
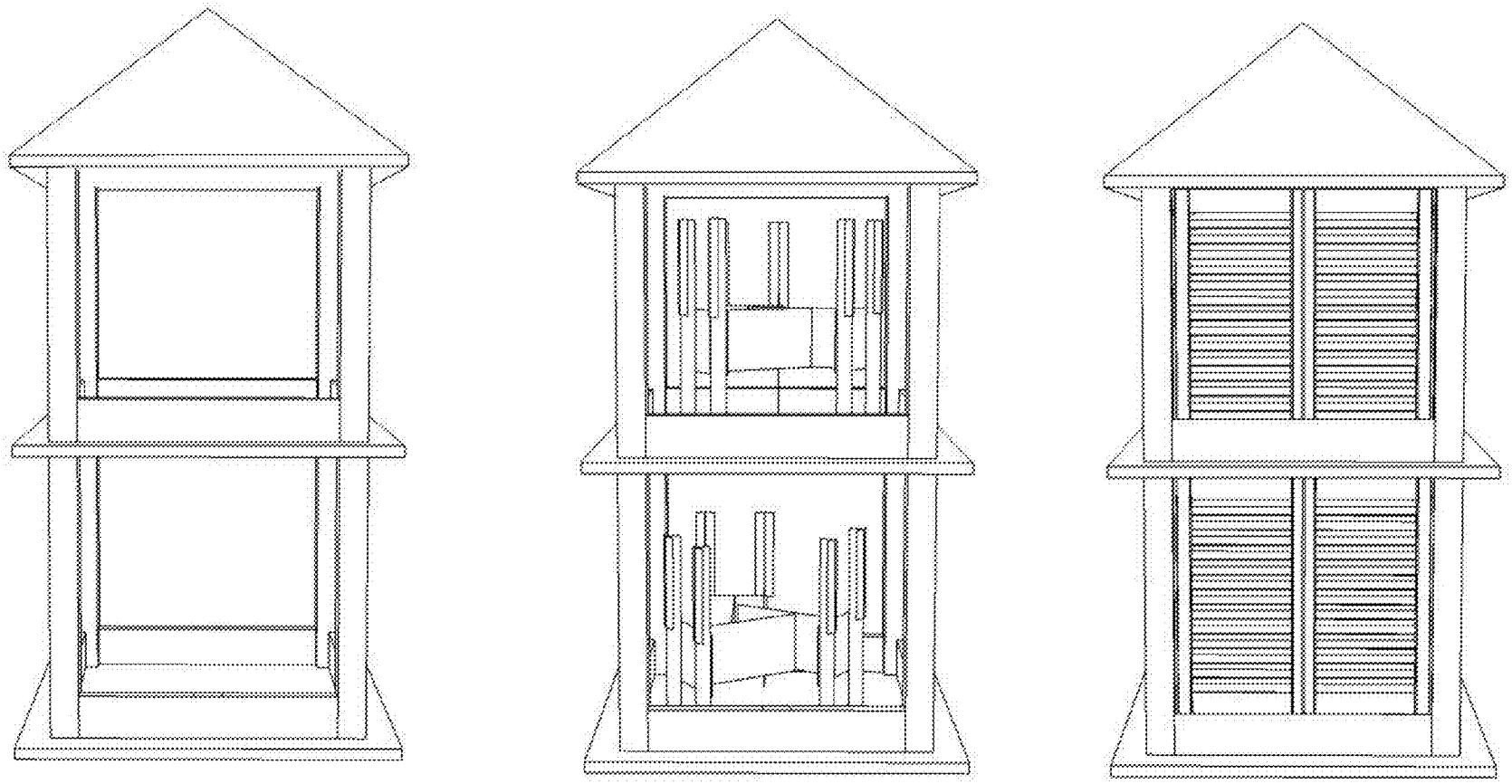

FIGS. 8 and 9A and 9B show basic appearance features of several further variations of antenna cupolas with or without shutters, with different roof profiles, and with or without clock stages and/or bell stages. While not shown, it is also possible to combine a bell stage with a clock stage and an antenna stage. With all of these different configurations possible by simply combining different modules to construct the cupola, it is apparent that the inventive tower structure and antenna cupola can be readily adapted to many different installation requirements, to give the appearance of a clock tower, a bell tower, a steeple, a ventilation cupola or the like. As shown at the left in FIG. 9B, another possibility is simply an open stage without clock, bell or antennas, whereby this open stage can serve as or simply appear to be an observation tower stage. Such an observation stage can be provided above or below an antenna stage. Any of the other stages can also be arranged above or below any other type of stage or the same type of stage. FIG. 9B also can be understood as representing the steps of erecting an empty cupola, installing the antennas in two antenna stages or rad centers, and then concealing the antenna stages with shutters.

Figure 10:
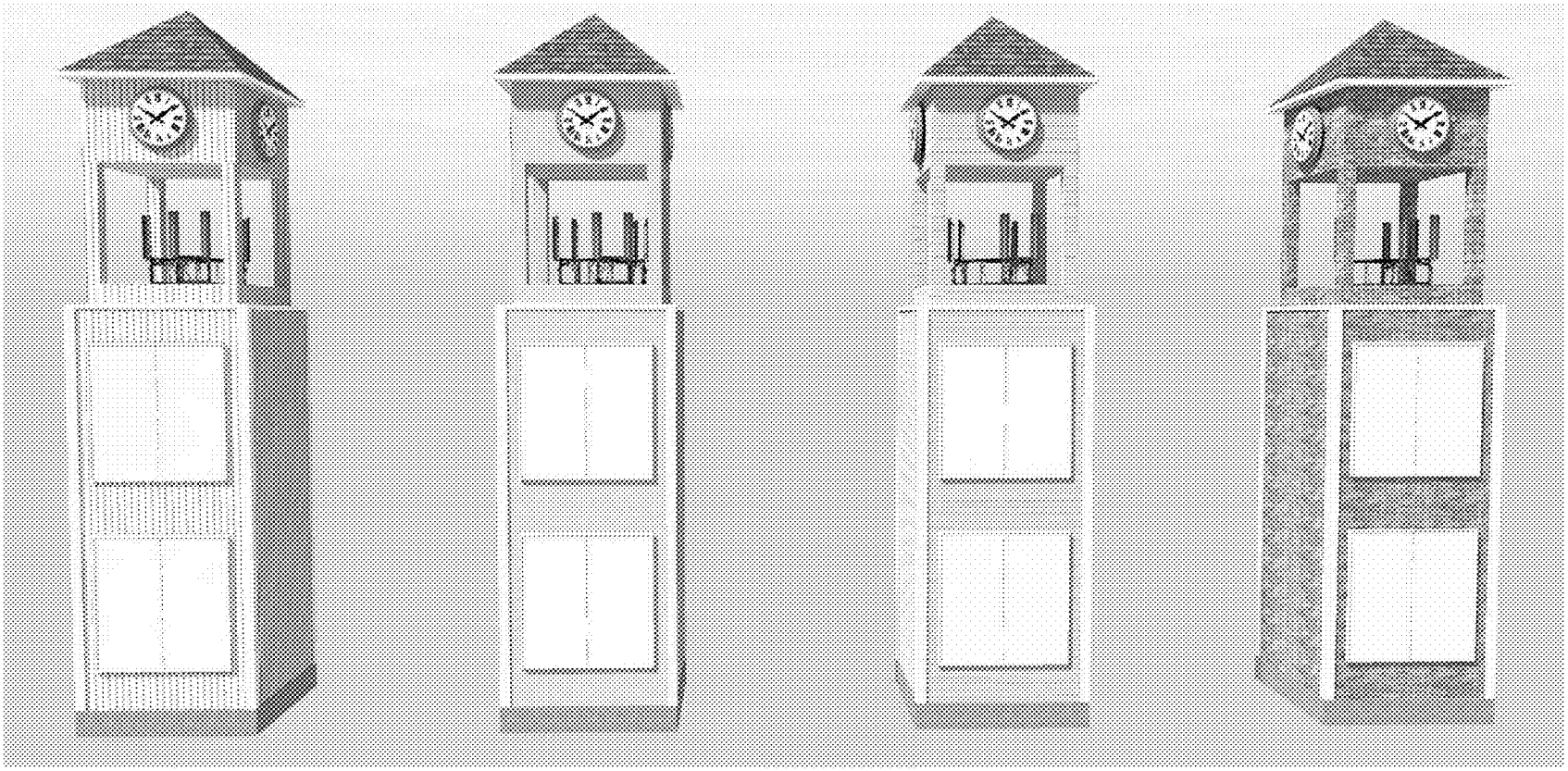
FIG. 10 shows examples of four different types of exterior cladding on a representative embodiment of a tower structure according to the invention.

FIG. 10 shows four different possibilities of the exterior facade cladding, namely for example metal cladding, stucco cladding, wood clapboard cladding and brick cladding. As a further alternative, the steel shell of the shipping container can simply be painted in any desired color(s) and pattern(s).

Figure 11:
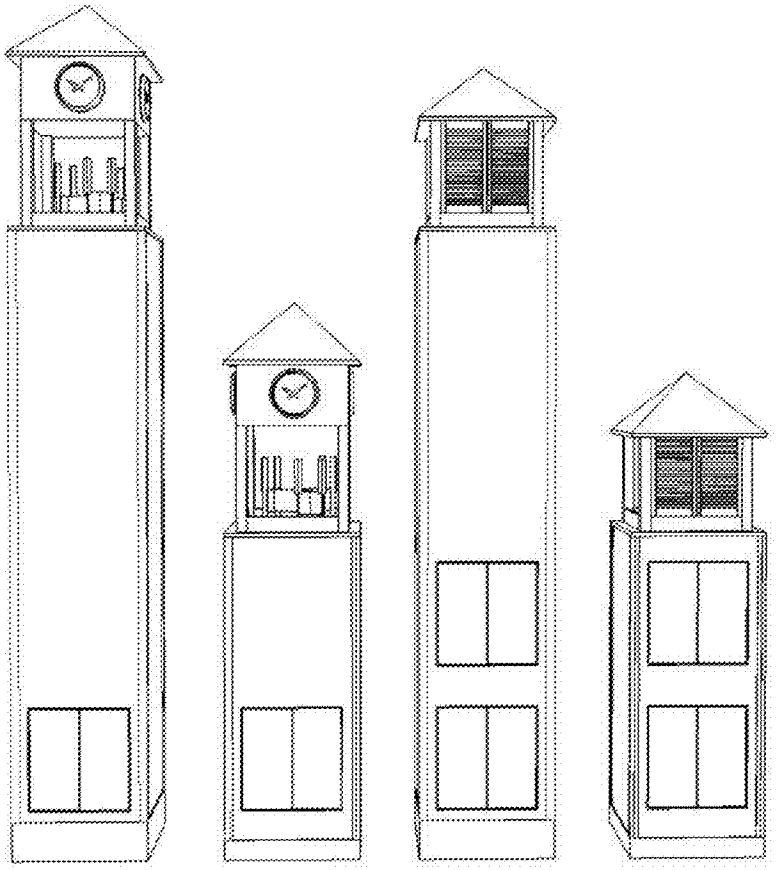
FIG. 11 shows frontal views of the basic design or appearance features of four embodiments of the tower structure according to the invention.

FIG. 11 shows the basic exterior design appearance of a tower based on a forty foot container with a single access door and a cupola having a single open antenna stage and a single clock stage, a twenty foot container tower with a single access door and a cupola having a single open antenna stage and single clock stage, a forty foot container tower with two access doors and a cupola having a shuttered antenna stage, and a twenty foot container tower with two access doors and a cupola having a shuttered antenna stage. Access doors can be provided on one side or two or more sides of the container tower.

Figure 12:
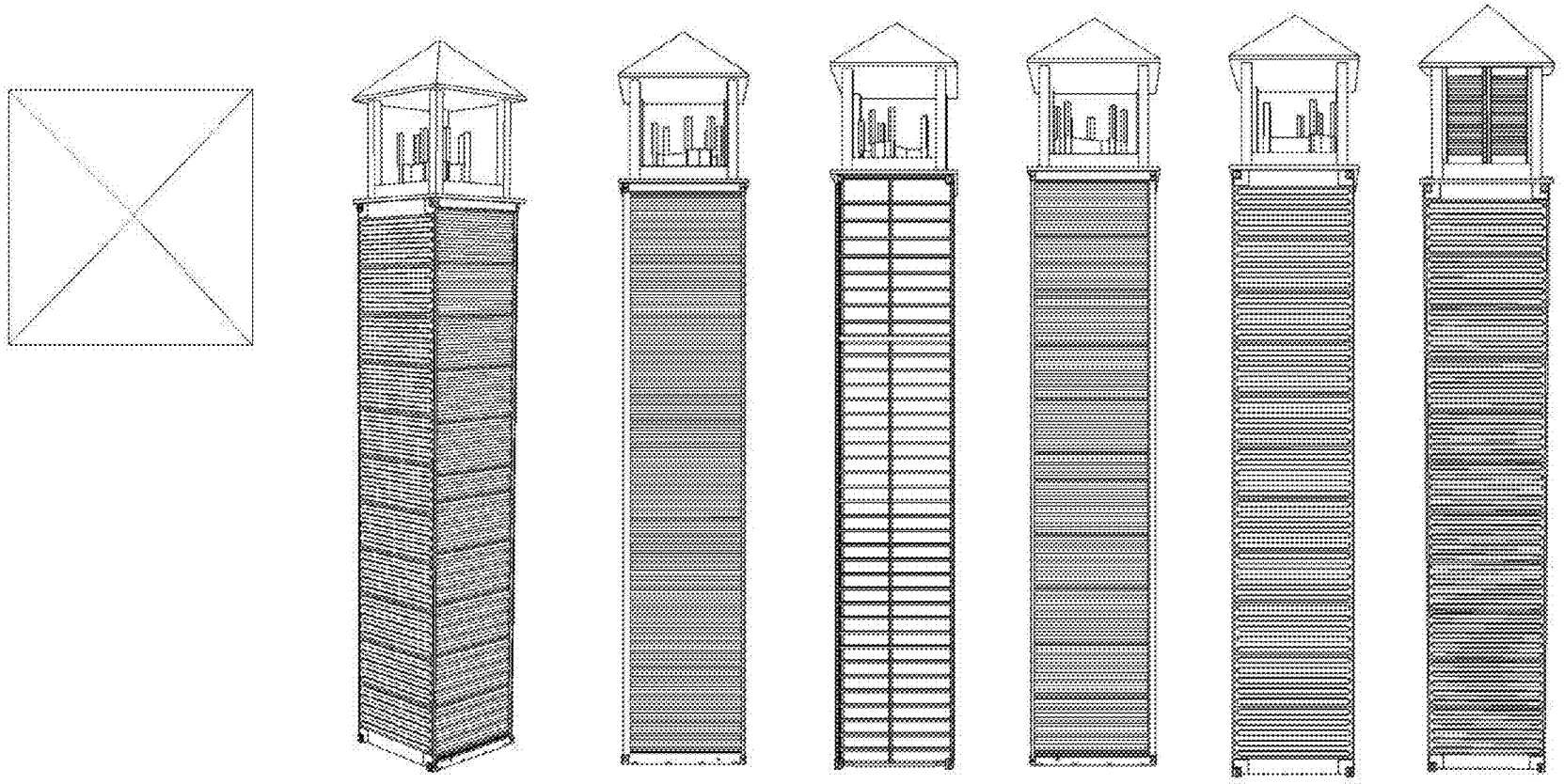
FIGS. 12 to 18: each show views in several directions, of respective embodiments of tower structures according to the invention before the installation of exterior facade cladding onto a tower based on one, two or three standardized shipping containers.

FIG. 12 shows four side views from four directions, a perspective view and a top view of the basic design appearance of a tower based on a forty foot container with a single antenna stage in the antenna cupola, as well as a view with added shutters on the antenna cupola. FIG. 12 shows the appearance of the tower without or before installation of an exterior facade cladding, or with just paint as the exterior finish on the tower. This tower omits access doors.

Figure 13:
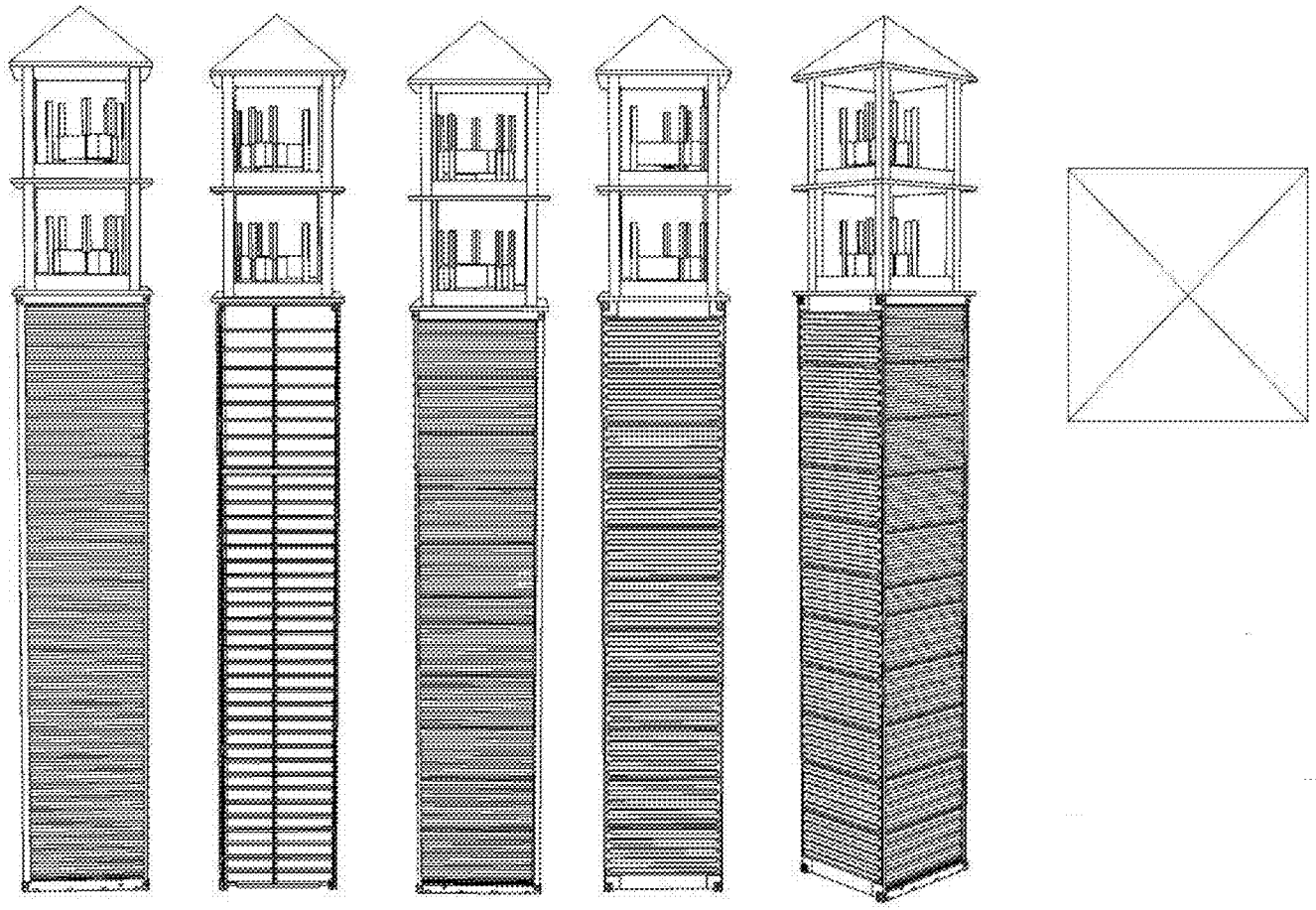
Figure 14:
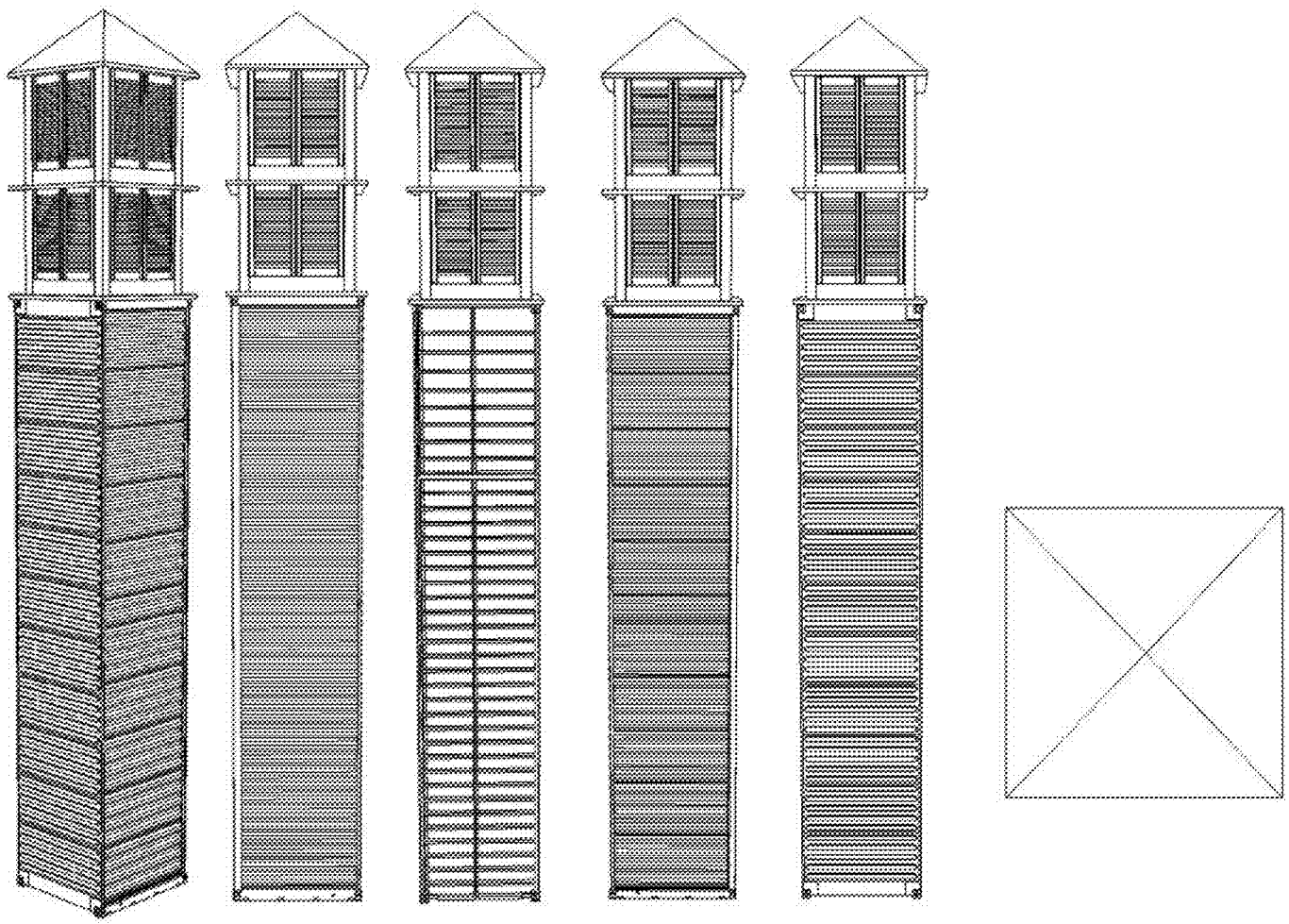

FIGS. 13 and 14 show four side views, a perspective view and a top view of a tower based on a forty foot shipping container and a cupola having two antenna stages. FIG. 13 shows open antenna stages, while FIG. 14 shows the antenna stages concealed with shutters.

FIGS. 15 to 18 show various different possible configurations of a tower structure using more than one shipping container. While these drawings show examples, they are not exhaustive of all possible different configurations. To the contrary, due to the modular sizing and construction of the shipping containers, it is possible to combine several shipping containers in various configurations and combinations. Especially with the addition of bracing and reinforcement members as disclosed herein, the possible combination configurations are almost limitless.

Figure 15:
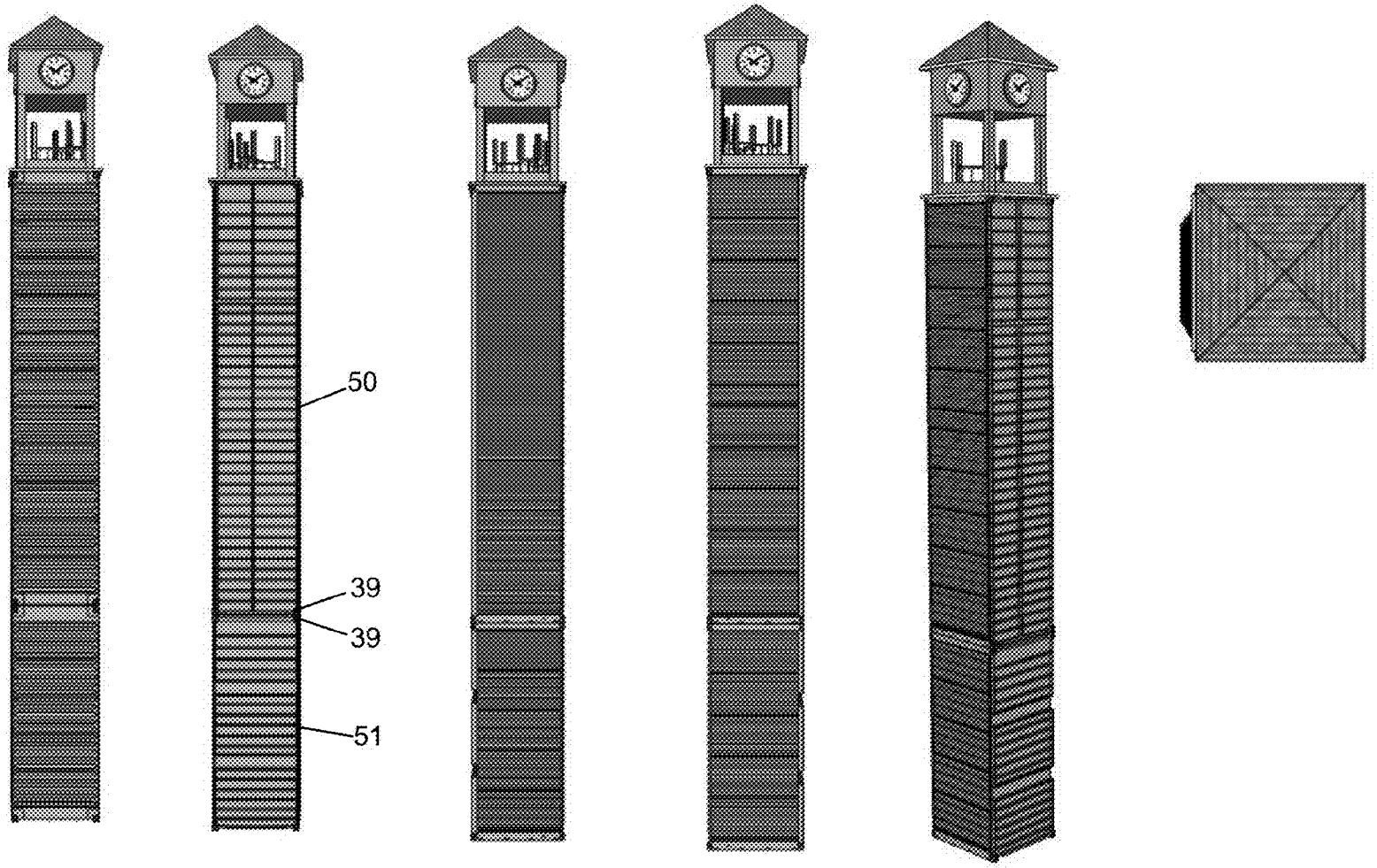

FIG. 15 shows a first vertical forty foot shipping container 50 arranged on top of a second vertical twenty foot shipping container 51. This provides a tower height of approximately sixty feet. The shipping containers are readily secured together by the mounting flanges or connector plates 39 provided at the ends thereof. Interior bracing such as diagonal cable cross bracing can also extend continuously across this jointto provide further structural strength and security. In such an arrangement, the closed front end wall of the second shipping container 51 is at least partially removed, as are the rear doors of both shipping containers 50 and 51.

Figure 16:
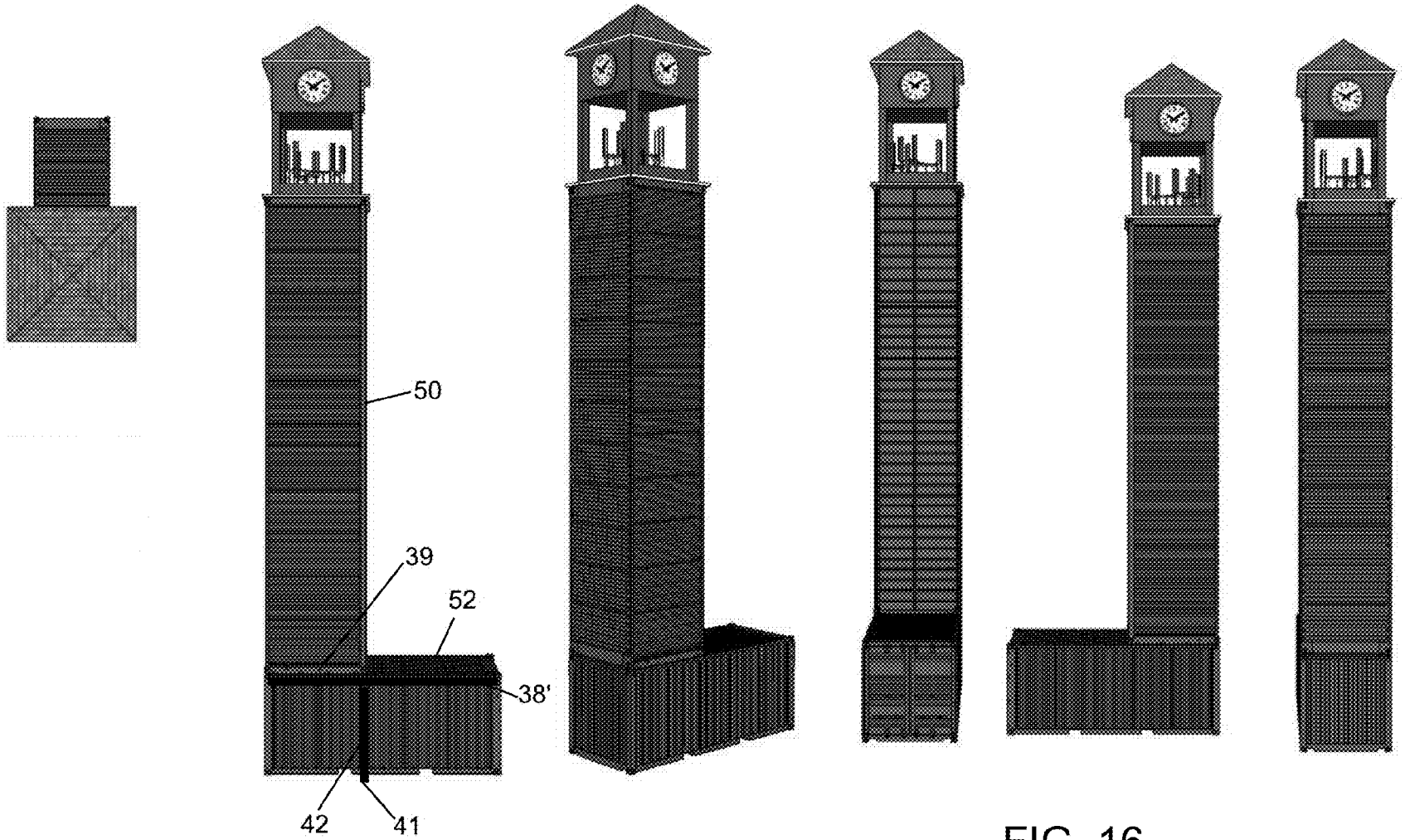

FIG. 16 shows an L-shaped tower configuration achieved with a first vertical forty foot shipping container 50 mounted on top of a second horizontally oriented twenty foot shipping container 52. In this configuration, as discussed above with reference to FIG. 22F, an additional longitudinal reinforcement frame 38' is provided along the length of the bottom shipping container 52 so as to carry and properly distribute the load of the upper shipping container 50 onto the horizontally oriented base container 52. Also, to match the height of the twist lock connectors or mounting pads or feet at the ends of the container, additional mounting feet or pads 41 or shims are provided along the entire length of the base container 52 or at least at the location under the medial wall of the upper shipping container 50. At this location, it is also preferred to install an additional transverse reinforcement frame or posts 42 running transversely to the longitudinal axis of the base container 52, so as to carry the load vertically downwardly from the medial wall of the upper container 50 down through the extra foot pads 41 into the underlying foundation. With such a configuration, the base container 52 not only adds more height to the tower, but also provides additional equipment shelter space and further provides additional lateral stability for the tower against wind loads and the like. In such a configuration, the wall (or actually ceiling) of the base container 52 adjoining the bottom end of the upright container 50 is cut away to allow clear open access, or simply an access opening for a ladder is provided, so that the container wall or ceiling remains to serve as an equipment floor in the tower. The exterior exposed portion of the ceiling of the base container 52 will serve as a roof of this container portion and thus be provided with a weather-tight membrane or the like. Any known roof sheathing and roofing material can be provided to ensure a weather-tight roof construction. Alternatively, a roof structure matching the appearance of the antenna cupola roof can be built on top of the exposed portion of the base container 52.

Figure 17:
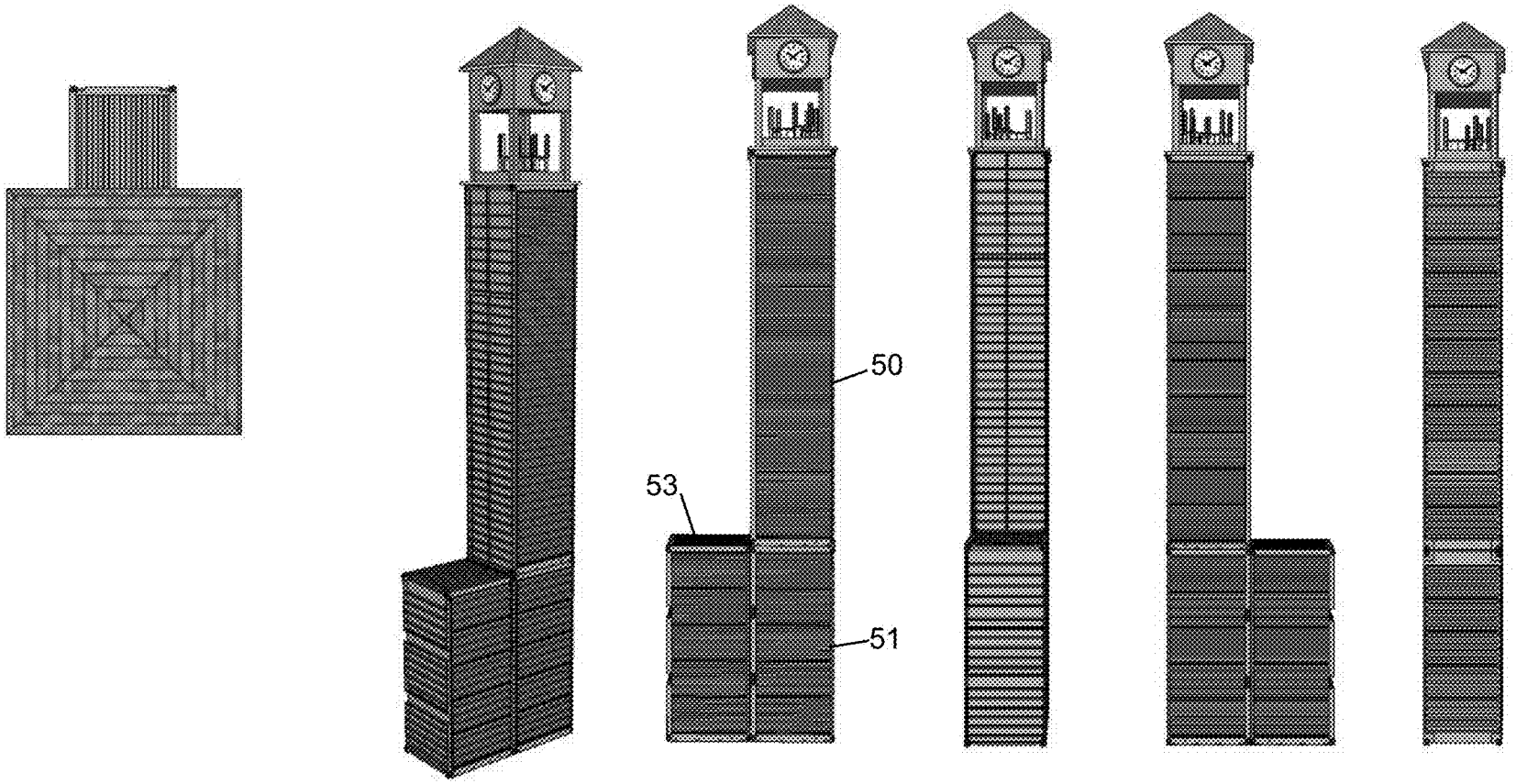

FIG. 17 shows a configuration using three containers, namely a forty foot container 50 standing vertically on top of a vertically oriented twenty foot container 51, which is coupled next to another vertically standing twenty foot container 53. In this configuration, access doorways are cut through the adjoining walls, floors or ceilings of the two twenty foot containers 51 and 53, or these adjoining metal surfaces are entirely or mostly cut away to provide a large unobstructed interior space. In either case, additional floors for equipment rooms can be installed as desired.

Figure 18:
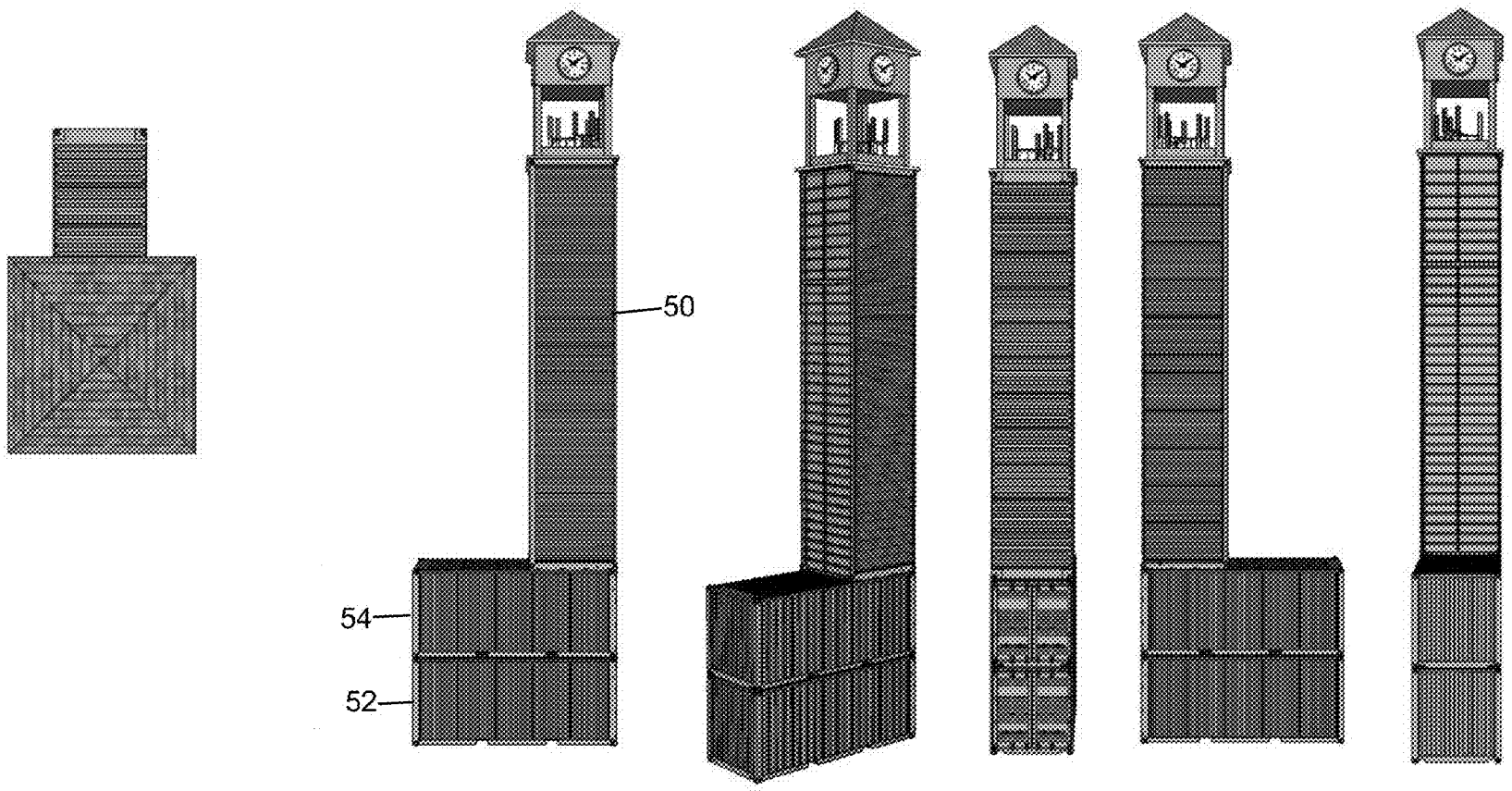

FIG. 18 shows a configuration in which a horizontally oriented twenty foot container 54 is stacked on top of another horizontally oriented twenty foot container 52, and a vertically oriented forty foot container 50 is stacked vertically thereon. Once again the adjoining ceiling and floor of the two base containers 52 and 54 are either entirely or substantially cut away, or only man accessways are cut through these steel surfaces, as desired for dividing the interior space into several equipment rooms and work rooms. Just like the configuration discussed above in FIG. 16 and FIG. 22B, the configurations of FIG. 17 and FIG. 18 preferably also include additional bracing, load-spreading reinforcements, and mounting footpads.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. An antenna tower structure comprising:

a foundation;

a tower comprising a modified steel shipping container supported on said foundation in an upright orientation with a longitudinal axis of said shipping container oriented substantially vertically, and having additional longitudinal reinforcement members along at least two longitudinal edges of said shipping container, at least one access door mounted in or on an access opening cut in a side of said shipping container, mounting hardware attached at a bottom end of said shipping container by which said shipping container is secured, and an access ladder or stairway mounted in or on said shipping container and extending longitudinally along said shipping container to provide access to an upper end of said shipping container;

at least one antenna mounted on said tower; and electronics equipment that is electrically connected with said antenna and arranged in an interior space within said shipping container accessible via said access door.

2. The antenna tower structure according to claim 1, further having at least one person passage opening cut in said upper end of said shipping container, and wherein said access ladder or stairway is mounted in said shipping container to provide access from said interior space to said person passage opening in said upper end.

3. The antenna tower structure according to claim 2, further having a weather-tight hatch that covers said person passage opening, and wherein said interior space in said shipping container is a weather-tight enclosure.

4. The antenna tower structure according to claim 1, further having at least one floor extending along a plane normal to said longitudinal axis in said shipping container and dividing said interior space into plural spaces.

5. The antenna tower structure according to claim 1, further having additional mounting hardware attached at said upper end of said shipping container, and wherein said tower further comprises an antenna cupola mounted on said upper end of said shipping container and secured to said additional mounting hardware, said antenna cupola includes an antenna stage and a roof mounted above said antenna stage, and said antenna is mounted in said antenna stage under said roof.

6. The antenna tower structure according to claim 5, wherein said antenna stage comprises four vertically extending cupola legs at a perimeter of an open space in which said antenna is received, and said cupola legs are made of non-metallic composite material.

7. The antenna tower structure according to claim 6, wherein said antenna stage further comprises non-metallic shutters or non-metallic facade cladding panels arranged to cover openings on said perimeter between adjacent ones of said cupola legs.

8. The antenna tower structure according to claim 5, wherein said antenna cupola further comprises a second antenna stage stacked under said roof, and said antenna tower structure further comprises another antenna mounted in said second antenna stage.

9. The antenna tower structure according to claim 5, wherein said antenna cupola further comprises a clock stage with an externally visible clock stacked above or below said antenna stage under said roof.

10. The antenna tower structure according to claim 5, wherein said antenna cupola further comprises a bell stage with an externally visible bell stacked above or below said antenna stage under said roof.

11. The antenna tower structure according to claim 1, further having ballistic protection panels mounted on a wall of said shipping container.

12. The antenna tower structure according to claim 1, wherein said bottom end of said shipping container is supported directly on said foundation and secured directly to said foundation by said mounting hardware.

13. The antenna tower structure according to claim 1, wherein said shipping container is a first shipping container, said tower further comprises a modified steel second shipping container of a size smaller than said first shipping container, said second shipping container is arranged on said foundation under or next to said first shipping container, said first shipping container further has a first opening, said second shipping container has additional mounting hardware by which said second shipping container is secured to said first shipping container and has a second opening that aligns and communicates with said first opening, and said second shipping container is oriented with a longitudinal axis thereof extending vertically.

14. The antenna tower structure according to claim 13, wherein said tower further comprises a modified steel third shipping container of a size the same as said second shipping container, said third shipping container is oriented with a longitudinal axis thereof extending vertically, and said third shipping container is arranged on said foundation next to said second shipping container.

15. The antenna tower structure according to claim 1, wherein said shipping container is a first shipping container, said tower further comprises a modified steel second shipping container of a size smaller than said first shipping container, said second shipping container is arranged on or above said foundation under or next to said first shipping container, said first shipping container further has a first opening, said second shipping container has additional mounting hardware by which said second shipping container is secured to said first shipping container and has a second opening that aligns and communicates with said first opening, and said second shipping container is oriented with a longitudinal axis thereof extending horizontally.

16. The antenna tower structure according to claim 15, wherein said tower further comprises a modified steel third shipping container of a size the same as said second shipping container, said third shipping container is oriented with a longitudinal axis thereof extending horizontally, and said third shipping container is arranged on said foundation under said second shipping container.

17. A combination comprising:

a modified steel shipping container adapted to be erected into an upright orientation as a tower with a longitudinal axis of said shipping container oriented substantially vertically, and an antenna cupola adapted to be mounted on said shipping container;

wherein:

said shipping container has four sides, a front end and a back end, and having additional longitudinal reinforcement members along at least two longitudinal edges of said shipping container, additional mounting hardware respectively attached at said front end and at said back end of said shipping container, at least one access door mounted in or on an access opening cut in at least one of said four sides of said shipping container, a weather-tight access hatch covering a person passage opening cut in said front end of said shipping container, and an access ladder or stairway mounted in said shipping container and extending longitudinally along said shipping container from an interior area accessible via said access door to said person passage opening, and wherein loading doors that were originally present on said back end of said steel shipping container have been removed;

said antenna cupola comprises a cupola frame that is made of non-metallic composite material and is configured and adapted to be secured to said mounting hardware on said front end of said shipping container, and a roof arranged on top of said cupola frame, wherein said cupola frame defines therein an empty space under said roof configured and adapted to receive at least one antenna mounted therein; and said mounting hardware at said back end is engineered to securely attach said back end of said shipping container to an underlying structure when said shipping container is erected in said upright orientation.

18. A method of erecting an antenna tower comprising:

obtaining the combination according to claim 17, including said modified shipping container and said antenna cupola;

installing a foundation;

erecting said shipping container into said upright orientation with said longitudinal axis thereof oriented substantially vertically, and with a load of said shipping container supported on said foundation;

securing said back end of said shipping container as a bottom end of said tower via said mounting hardware provided on said back end; and mounting said antenna cupola on said front end and securing said cupola frame to said mounting hardware provided on said front end.

19. The method according to claim 18, further comprising mounting an antenna in said empty space of said antenna cupola, mounting electronics equipment in said interior area of said shipping container, and electrically connecting said antenna with said electronics equipment.

20. The method according to claim 18, further comprising attaching, on an exterior of said shipping container, an exterior facade cladding selected from brickwork, stonework, wood siding, vinyl siding, metal siding, composite siding, stucco, shingles and tiles.

* * * * *